US008984832B2

(12) United States Patent
Busby

(10) Patent No.: US 8,984,832 B2
(45) Date of Patent: Mar. 24, 2015

(54) FLOORING, DECK AND PATIO SURFACE SYSTEM AND METHOD OF USE

(76) Inventor: Philip J. Busby, Beaverton, OR (US)

( * ) Notice: Subject to any disclaimer, the term of this patent is extended or adjusted under 35 U.S.C. 154(b) by 317 days.

(21) Appl. No.: 13/091,085

(22) Filed: Apr. 20, 2011

(65) Prior Publication Data

US 2011/0192106 A1 Aug. 11, 2011

Related U.S. Application Data

(63) Continuation-in-part of application No. 12/416,002, filed on Mar. 31, 2009, now abandoned, which is a continuation-in-part of application No. 11/669,586, filed on Jan. 31, 2007, now abandoned.

(60) Provisional application No. 60/764,190, filed on Jan. 31, 2006.

(51) Int. Cl.

| | |
|---|---|
| ***E04B 2/30*** | (2006.01) |
| ***E04F 13/08*** | (2006.01) |
| ***E04C 1/00*** | (2006.01) |
| ***E04B 9/00*** | (2006.01) |
| ***E04F 15/08*** | (2006.01) |
| ***E04F 15/02*** | (2006.01) |
| ***E04F 15/024*** | (2006.01) |

(52) U.S. Cl.

CPC ..... *E04F 15/08* (2013.01); *E04F 15/02183* (2013.01); *E04F 15/02447* (2013.01)

USPC ..... 52/489.2; 52/385; 52/309.13; 52/126.5

(58) Field of Classification Search

CPC ..... E04C 2/42; E04C 2/422; E04C 2/427; E04C 2/428; E01C 5/00; E01C 5/005; E01C 5/20; E01C 9/10; E04F 15/00; E04F 15/0215; E04F 15/02155; E04F 15/02183; E04F 15/02417; E04F 15/024; E04F 15/02452; E04F 15/02458; E04F 15/02494; E04F 15/02405; E04F 15/02044; E04F 19/10

USPC ..... 52/300, 301, 309.13, 389, 638, 745.05, 52/479, 480, 459–472, 596, 597, 385, 386, 52/650.3, 660, 661, 673, 263, 220.1, 52/220.5, 126.1, 126.2, 126.5, 126.6, 52/489.1, 489.2

See application file for complete search history.

(56) References Cited

U.S. PATENT DOCUMENTS

| | | | | | |
|---|---|---|---|---|---|
| 1,707,533 | A | * | 4/1929 | Nagin | 52/581 |
| 3,057,271 | A | * | 10/1962 | Butler et al. | 52/179 |
| 3,185,269 | A | * | 5/1965 | Nagin | 52/489.1 |
| 3,318,057 | A | * | 5/1967 | Norsworthy | 52/126.6 |
| 3,742,671 | A | * | 7/1973 | Ellis | 52/507 |
| 4,277,923 | A | * | 7/1981 | Rebentisch et al. | 52/126.6 |
| 4,558,544 | A | * | 12/1985 | Albrecht et al. | 52/126.6 |
| 4,571,200 | A | * | 2/1986 | Serna | 446/85 |

(Continued)

*Primary Examiner* — Basil Katcheves
*Assistant Examiner* — Theodore Adamos
(74) *Attorney, Agent, or Firm* — Mark S. Hubert

(57) ABSTRACT

A system and method for providing an outdoor flooring such as a lightweight deck surface, employs a fiber reinforced polymer structural panel with internally tapered plural grid openings therein. A connector is driven into selected openings to enable the panel to be secured to a deck frame, or in the case of an impenetrable deck frame, a series of plates are used with or without pipe stanchions to make a floating or raised floating planar surface. A surfacing material, such as a quarried stone, is attached to the top of the panel, providing a stone deck surface without requiring substantial structural support.

10 Claims, 28 Drawing Sheets

(56) References Cited

U.S. PATENT DOCUMENTS

| | | | | | |
|---|---|---|---|---|---|
| 4,671,699 | A * | 6/1987 | Roach | 404/41 |
| 4,745,715 | A * | 5/1988 | Hardwicke et al. | 52/126.6 |
| 4,749,302 | A * | 6/1988 | DeClute | 404/37 |
| RE33,220 | E * | 5/1990 | Collier | 52/263 |
| 4,996,804 | A * | 3/1991 | Naka et al. | 52/126.6 |
| 5,118,147 | A * | 6/1992 | Correll | 292/256 |
| 5,265,386 | A * | 11/1993 | Muhlethaler | 52/126.6 |
| 5,363,614 | A * | 11/1994 | Faulkner | 52/263 |
| 5,911,664 | A * | 6/1999 | Masters et al. | 52/698 |
| 6,000,184 | A * | 12/1999 | Fernandes | 52/389 |
| 6,199,335 | B1 * | 3/2001 | Brenot et al. | 52/480 |
| 6,363,685 | B1 * | 4/2002 | Kugler | 52/745.05 |
| 6,440,525 | B1 * | 8/2002 | Kessler et al. | 428/99 |
| 6,520,471 | B2 * | 2/2003 | Jones et al. | 248/346.5 |
| 6,851,236 | B1 * | 2/2005 | Harvey | 52/403.1 |
| RE40,217 | E * | 4/2008 | Masters et al. | 52/698 |
| 7,360,343 | B1 * | 4/2008 | Spransy et al. | 52/263 |
| 7,386,955 | B1 * | 6/2008 | Repasky | 52/126.6 |
| 2003/0177723 | A1 * | 9/2003 | Jakob-Bamberg et al. | 52/263 |
| 2004/0035071 | A1 * | 2/2004 | Ho et al. | 52/390 |
| 2004/0074170 | A1 * | 4/2004 | Huang | 52/220.1 |
| 2005/0284082 | A1 * | 12/2005 | Smith | 52/650.3 |
| 2006/0260233 | A1 * | 11/2006 | Schluter | 52/302.3 |
| 2007/0175132 | A1 * | 8/2007 | Spransy et al. | 52/263 |
| 2008/0141601 | A1 * | 6/2008 | Mead | 52/263 |

* cited by examiner

12

FLOORING, DECK AND PATIO SURFACE SYSTEM AND METHOD OF USE

CROSS-REFERENCE TO RELATED APPLICATIONS

This application incorporates by reference and is a continuation-in-part of U.S. patent application Ser. No. 12/416,002 filed Mar. 31, 2009, which is a continuation-in-part of U.S. patent application Ser. No. 11/669,586 filed Mar. 31, 2007, which claims priority of U.S. provisional patent application 60/764,190 filed Mar. 31, 2006.

BACKGROUND OF THE INVENTION

This invention relates to outdoor flooring, surfaces for decks, rooftop terraces, patios and the like, and more particularly, to a decking system and method for enabling use of surface materials that would ordinarily lack suitable structural features to accommodate deck, rooftop terraces or patio applications.

Stone or stone-like walkways, terraces, patios and steps are frequently used at homes and businesses, as the appearance is attractive and enjoyed by many. Generally, these stones must be laid onto a level, on-grade, firm soil. Walkway and step stones are typically rather thick, to provide sufficient internal structural properties to support weight necessary in walkway and step use. In addition, thin-gauged stones used in this same manner, with no internal structural properties, require a thick concrete pad for support.

Many residential second floor decks are sloped for drainage or are above waterproofed lower decks or living spaces and as such cannot employ mechanical penetrations that would breech the integrity of the decks protective waterproofing. Common commercial roofs or decks have multiple slopes and numerous protrusions such as drains or vents and must have an elevated substrate system above the waterproofing to attach and or support the stones in order to present an aesthetically attractive and structurally stable planar array of stone. Common joist framed decks that would be finished with the same stone or stone-like material would require a solid, water resistant structural support spanning between multiple joist framing.

Henceforth, an outdoor flooring, deck, rooftop terrace and patio surface system would fulfill a long felt need in the construction industry. This new invention utilizes and combines known and new technologies in a unique and novel configuration to overcome the aforementioned problems and accomplish this.

SUMMARY OF THE INVENTION

In accordance with the invention, a deck, rooftop terrace and patio surface system comprises a fiber reinforced structural panel employed as a substrate underlayment, a mounting fastener for enabling the panel to be mechanically secured to a deck joist framing, patio, or the like, a panel elevation, interconnecting and spacing system and a surfacing material bonded agent for attachment to the structural panel.

Accordingly, it is an object of the present invention to provide an improved deck system to enable use of stone or stone-like surface, of varying non-uniform shapes and sizes, of varying thicknesses, in above-ground framed deck and rooftop terrace applications.

It is a further object of the present invention to provide an improved system for the use of stone in deck, rooftop or patio applications where the deck, rooftop or patio alone would not allow for the aesthetic use of stones.

It is yet another object of the present invention to provide an improved method for providing a truly planar deck surface utilizing connectors that reside below the plane of affixation for the surface adornment stone.

Another objective of the present invention is to provide a deck, rooftop terrace or patio system adapted to support a thin-gauged stone or stone-like surface by field-bonding two dissimilar materials with a flexible bonding agent causing the materials to inherit the strengths of each and forming a new solid and stable structural flooring. The deck, rooftop terrace or patio or patio system shall allow water to pass directly past the stones and the panels as there will be no grouted spaces between the stone surfaces and the structural panels beneath them.

Another object of the present invention is to provide a deck or patio system adapted for use over waterproofed living space without requiring penetration of the waterproof membrane. The deck or patio system shall allow water to pass directly past the stones and the panels.

Another object of the present invention is to provide a system of deck or patio panels adapted for easy subdivision into panels sized adapted for use with conventionally sized commercially available stones or to adapt to standard building dimensions.

It is still another object of the present invention to provide a system and method for providing a new floating or raised surface over an existing damaged patio surface or waterproofed rooftop terrace. The floating system is to be constructed with commercially available piping and connector disks that serve as the devices to establish and maintain the spacing of panels in the raised surface and the devices to distribute the weight of the decking system in situations where there are no points of attachment between the panels and the underlying rooftop, patio or deck and to interconnect all adjoining panels so as to allow panels to be individually removed at anytime during the life of the finished surface.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

It has many of the advantages mentioned heretofore and many novel features that result in a new outdoor flooring, deck, rooftop terrace and patio surface system which is not anticipated, rendered obvious, suggested, or even implied by any of the prior art, either alone or in any combination thereof.

DETAILED DESCRIPTION

Figure 1:
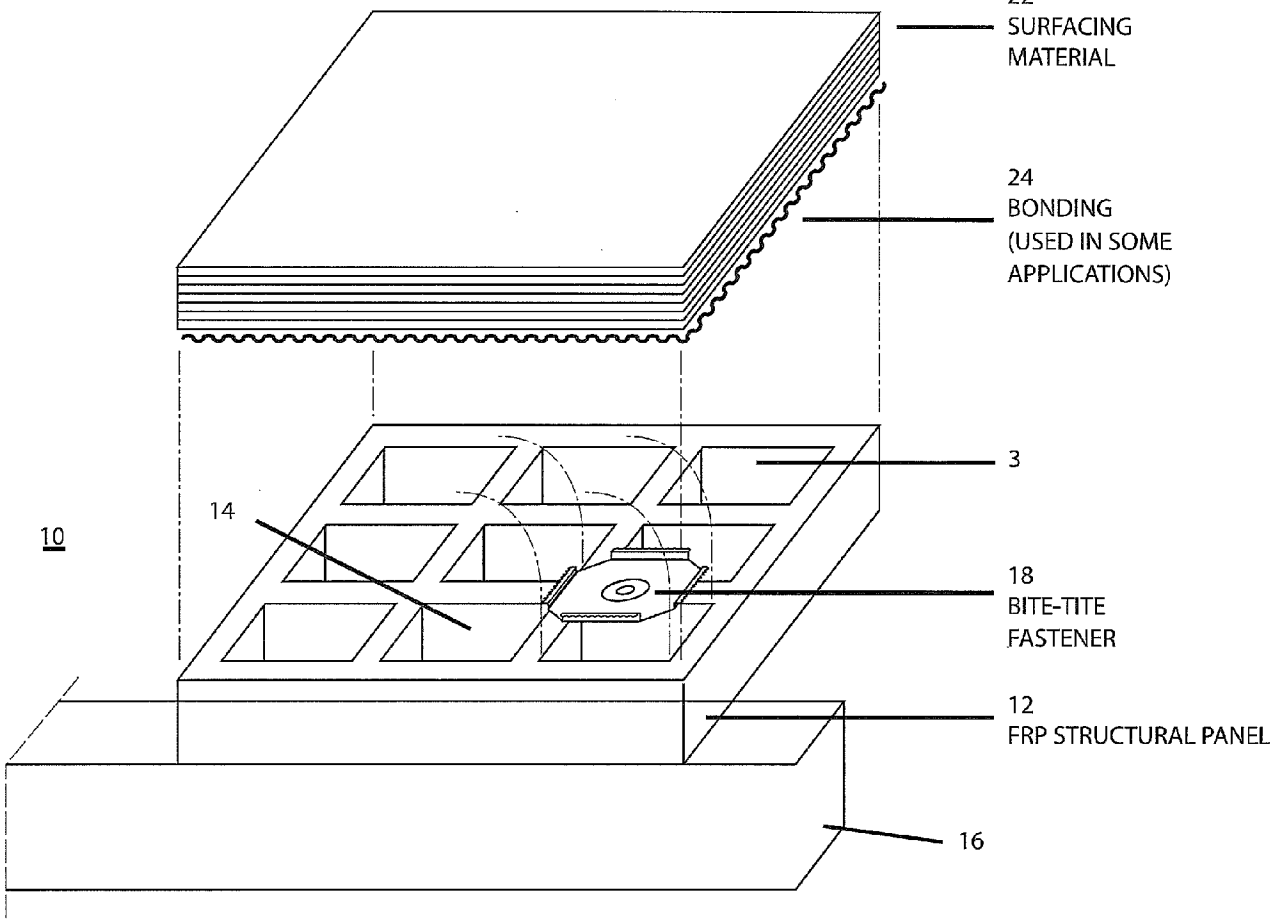
FIG. 1 is an exploded perspective view of a portion of the system according to the invention.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

Basically, the present invention supports an open celled structural panel that allows the placement of a variety of finished surfaces in any form and configuration and across adjoining interconnected structural panels, or within the panel dimension so that each finished structural panel is removable independently of others with the finished stone tile attached, the same being placed as glued surfaces or dry-laid floating surface materials and all with an open cell structure to allow moisture to drain through the structural panel. The structural panel may be installed directly atop the area to be floored or may be installed in a raised position above the area to compensate for any non horizontal or non planar anomalies in the area, such as may be found on the deck or rooftop of a commercial building. Further, the structural panels (raised or not) may be mechanically affixed to the area or may be installed as a floating sub floor, wherein the mass and friction of the entire sub floor assembly with the flooring installed maintains its horizontal position. The floating sub floor option is used where it is not desirable to have any penetrations into the underlying area to be floored, such as is the case when it forms the ceiling of another living space. This open celled structural floor panel can be mechanically secured to the underlying surface or framing members through the use of a connector that forms a biting, wedged friction against the angled walls of the open cells of the structural panel so as to provide a horizontal plate with a central orifice to receive a screw that passes through the connector and into the underlying surface. The connector with installed screw will rest in its final position no higher than flush with the top of the structural panel such that no machining is required to place a finished stone, tile, concrete surface directly over the structural panel. Prior art panels utilize connectors that span more than one of their open cells leaving a protuberance above the plane of the panel proper. The open cells of the structural floor panel taper inward from their top to bottom at approximately 2 degrees, with a minus 1 degree and plus 10 degree tolerance. The array of open cells in the structural panel is spaced and divided into standard 16" and 24" O.C. dimensions accommodating the cut down of a 48"×48" panel to 16"×48" or 24"×48" panels with a full perimeter bar structure so as to meet USA dimensional building standards and accommodate commercially available flooring products.

The bonding of the finished stone, tile, concrete floor tile or the like to the open celled structural plastic panel is accomplished using a flexible adhesive without any cement based bonding or bedding materials.

To accommodate the raised positioning of the structural panel a standard ABS pipe with a support plate affixed on either end is used as a stanchion to raise the panels and to act as a support base to transmit the load on the panel array to the underlying surface. Recommended stanchion spacing will prevent sagging anywhere in the panel system. The top face of the support plate has a removable centering spacer that when used in conjunction with the structural panels will interlock and properly space all adjoining panels. It is to be noted that whether the sub flooring system is raised or not it will create an open drainage space under the structural panel.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Referring to FIG. 1, an exploded perspective view of a portion of the system 10, a structural panel 12, suitably comprising a fiber reinforced polymer panel having a grid pattern of openings (open cells) 14 in the illustrated embodiment, is adapted to be received on top of a deck base structure, which may suitably comprise wood deck framing timbers or other framing material such as metal 16. A connector 18, described 5 in further detail in connection with FIGS. 2-5 herein, is adapted to be received in an open cell 14 so as to engage with the structural panel 12, seating such that the side walls 29 of connector reside within an open cell, below the top surface of the panel 12. The connector includes a central orifice 30 adapted to receive a mechanical fastener therethrough, preferably a screw 10 to secure the panel to the underlying deck base structure 16.

A surfacing material 22, which may comprise a cut stone having an aesthetically pleasing appearance, color and/or pattern, is suitably bonded to the structural panel, using a bonding material 24, for example. The surfacing material may also comprise manufactured stone-like material, tile, dry laid brick, concrete or stone pavers, for example.

The structural panel is suitably provided in sheets having dimensions of 4 feet by 4 feet, with a 1.5 inch square open cell size, approximately 1 inch thick. The individual grid openings narrow from the top of the panel to the bottom, such that they are wider at the top face than at the bottom. In the particular embodiment, the open cell is 1 5/16th inch at the top measured from interior edge to the opposite edge of an individual open cell, but is 1¼th inch at the bottom face of the panel. This corresponds to an approximate two degree downward taper of the inside open cell walls 3, although experimentally it has been shown that tapers from one degree to twelve degrees also work satisfactorily.

A suitable panel that is employed with the system and method may be a fiber reinforced general purpose polyester molded resin panel, although other materials may be used. The panel size is preferably 4 foot by 4 foot in the preferred embodiment, based on construction standards and practices, but may be otherwise re-sized to the desired dimensions, within a 1/16th inch tolerance, so as to provide a system that functions with 16 inch and 24 inch framing dimensions typically used in deck applications. Note, however the 48"×48" square dimension meets the standard USA building dimension layout. The panel can be provided in other sizes than the illustrated example, chosen to have sufficient support while spanning the supporting elements supporting the panel. Preferably the panel is a pre-configured dimensional size suitable for compliance with customary building practices.

Figures 2, 3:
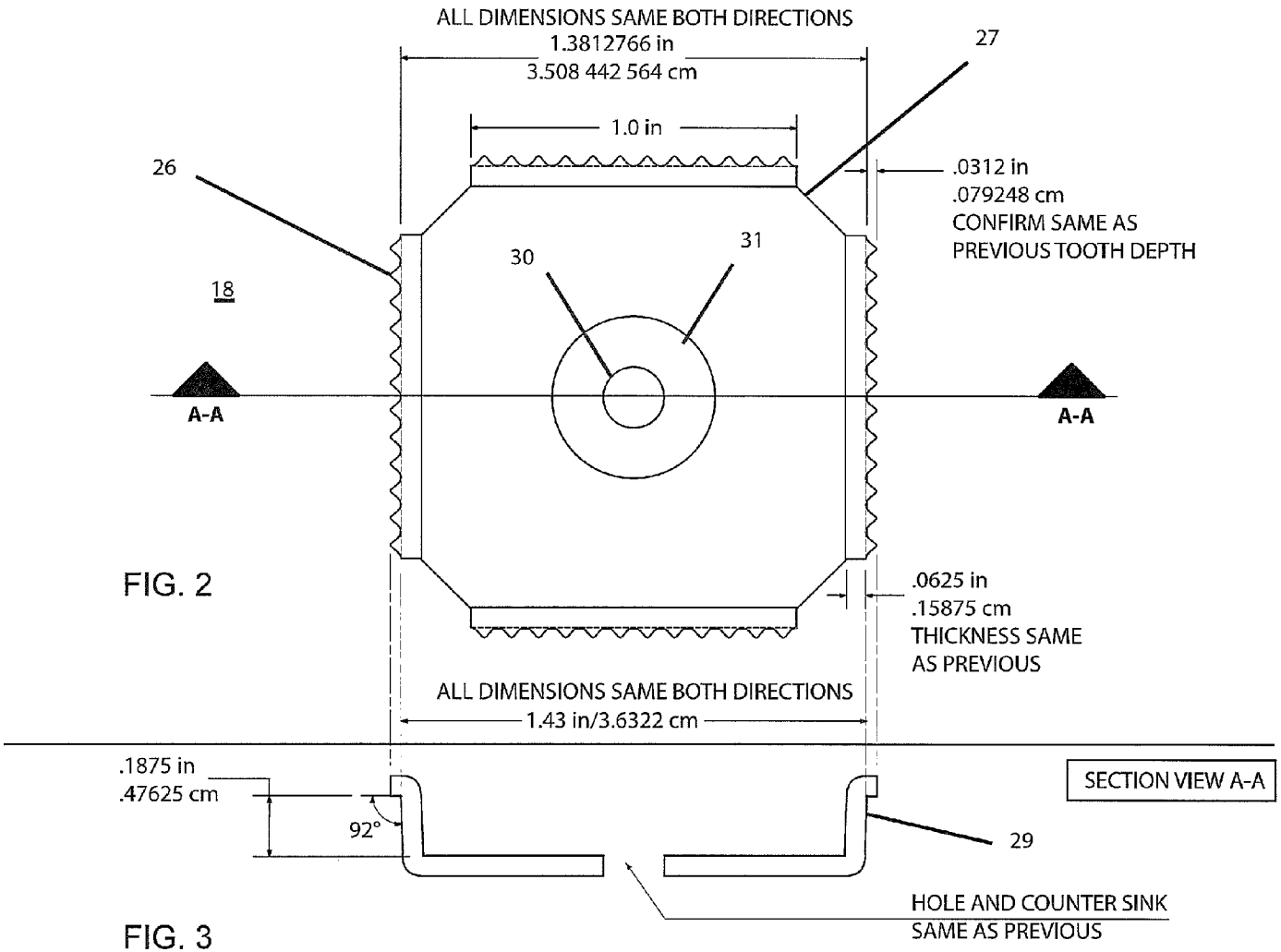
FIG. 2 is a top view of the connector of FIG. 1.
FIG. 3 is a sectional view of the connector of FIG. 1 taken along line A-A of FIG. 2.
Figure 4:
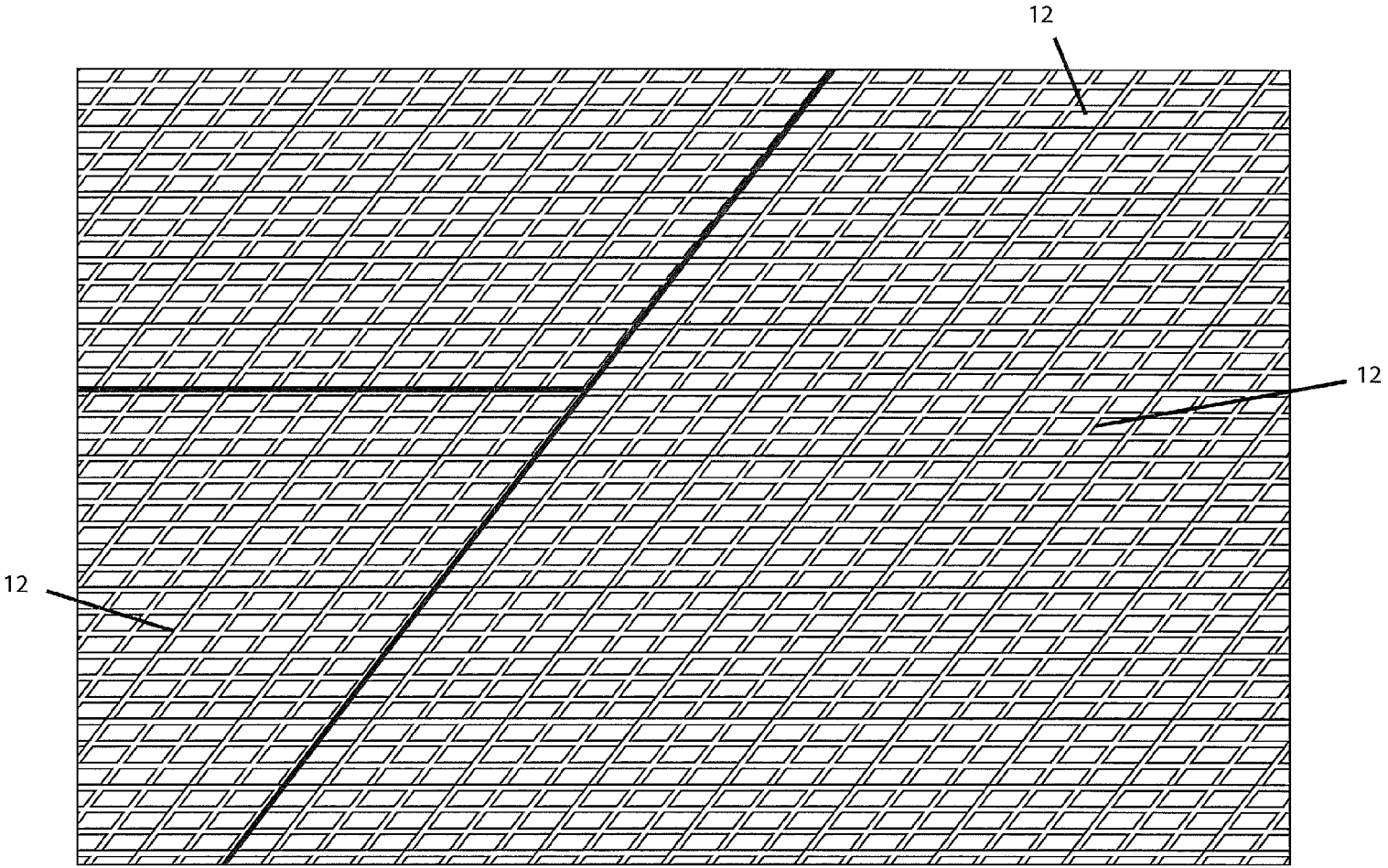
FIGS. 4-15 are illustrations of the steps of the method of installing a deck system in accordance with the invention.
Figure 5:
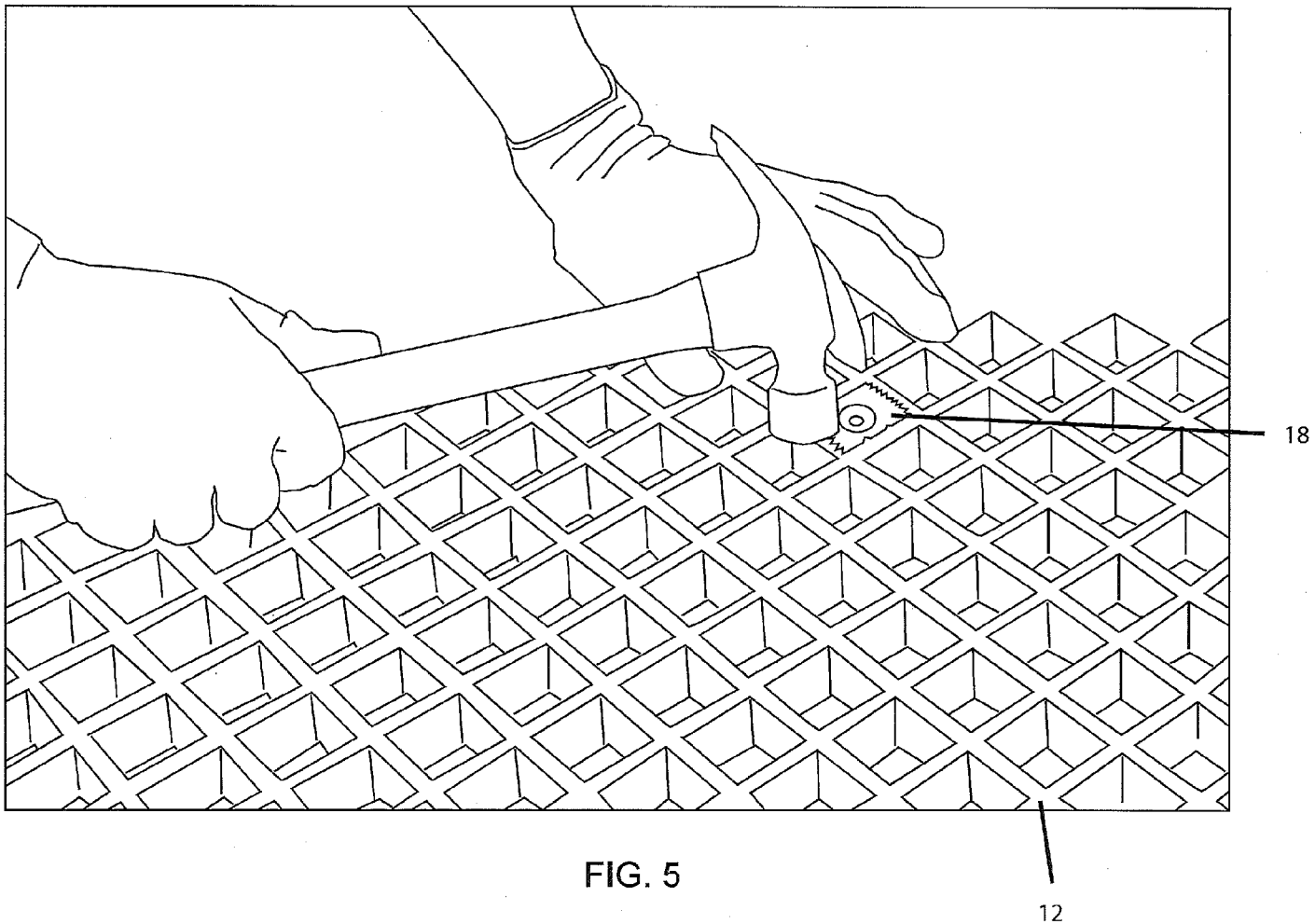

Referring now to FIGS. 2-3, which are views illustrating the connector 18 and explaining how it is manufactured, the connector in a preferred embodiment is made of a stainless steel material, stamped into the shape shown in FIG. 2. The connector is provided with a row series of twelve teeth 26 (serrated edge) on the edge of each its sides 29. The four peripheral corners 27 of the connector are chamfered or radiused such that the adjacent sides 29 do not meet (share a common edge.) Teeth 26 are suitably 3/64th inch in height. A central orifice 30 is provided in the connector, with a depressed annular region 31 about the orifice 30 so as to provide a 17/32 inch inner diameter flat bottom countersink, for receiving a fastener head as discussed below.

After the fastener is formed, its sides 29 are then bent approximately 88 degrees to matingly conform to match the approximate 2 degree inside taper of the open cells (with a tolerance of plus or minus 5 degrees) with the edge of serrated teeth 26 then again bent at approximately 90 degrees, so as to extend normally from the side walls and provide the configuration visible in FIG. 3. There is a taper between opposing side walls of the connector that matingly conforms to the taper of opposing side walls of the open cells. With the teeth bent to extend normally from the side walls so as to form a peripheral toothed flange, a flexing frictional wedge is formed, that increases in frictional resistance as the connector is forced further down in the open cell, as would be the case when the mechanical connector placed therethrough is tightened. The connector is installed with its side walls facing upward so that they can flex slightly to accommodate variances in the in the physical dimensions of the open cell that they are placed in. This allows for two things to happen: first the connecter can always be fit down into a cell such that the top surface of all of its four sides can reside below the top planar surface of the structural panel, and the connector can always be tightly wedged in any cell, albeit at a different elevation than neighboring connectors. In this design if the contractor chooses to tighten down one specific region of a panel or series of panels, for an aesthetic or structural reason, this can be done. Such may be necessary when installing structural panels on rooftop applications over uneven rolled roofing. In employing the system to provide a deck or patio surface, the installation steps illustrated in FIG. 4-15 are employed. The example shown in FIGS. 4-15 is in a deck installation, where a wood frame deck is present and the system is installed thereon.

Generally, first an optional waterproof membrane such as a 40 mil bituminous based material, is placed over the deck to protect the framing from water damage over time. Next, in FIG. 4, plural structural panels are cut and positioned as necessary to fit over the area of the deck framing that the system is to be installed upon. Next, (FIG. 5) connectors 18 are placed into openings 14 in the structural panel in locations where the panel is to be secured to the deck. The connectors are tapped with a hammer so as to have the top of the connectors be flush with the top surface of the structural panel. The open corner design of the connectors allow the sides 29 to flex to accommodate the frictional engagement especially when the connector is placed in the open cell slightly askew or when the cell walls have slight differences in their respective tapers.

Figure 6:
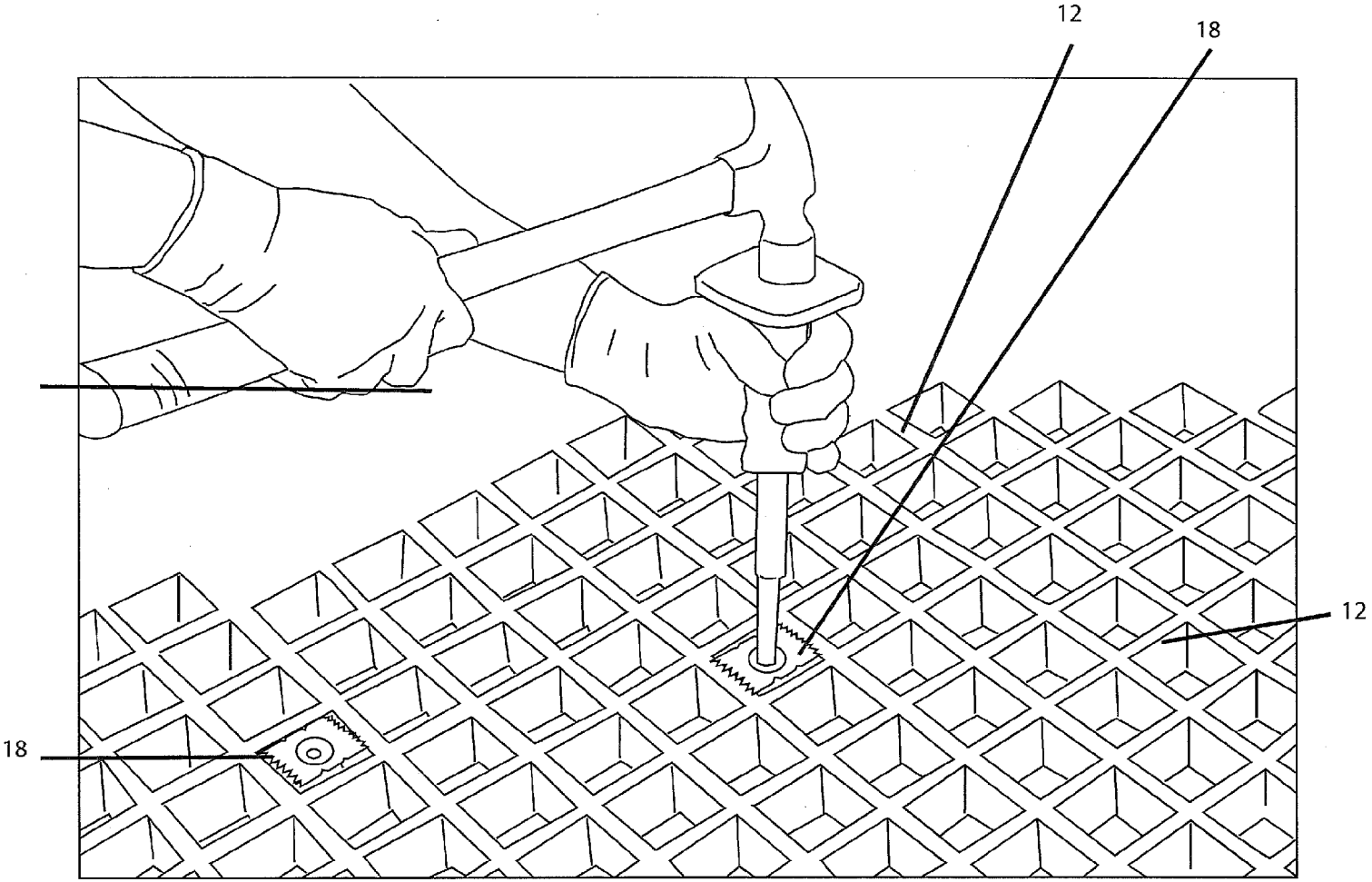
Figure 7:
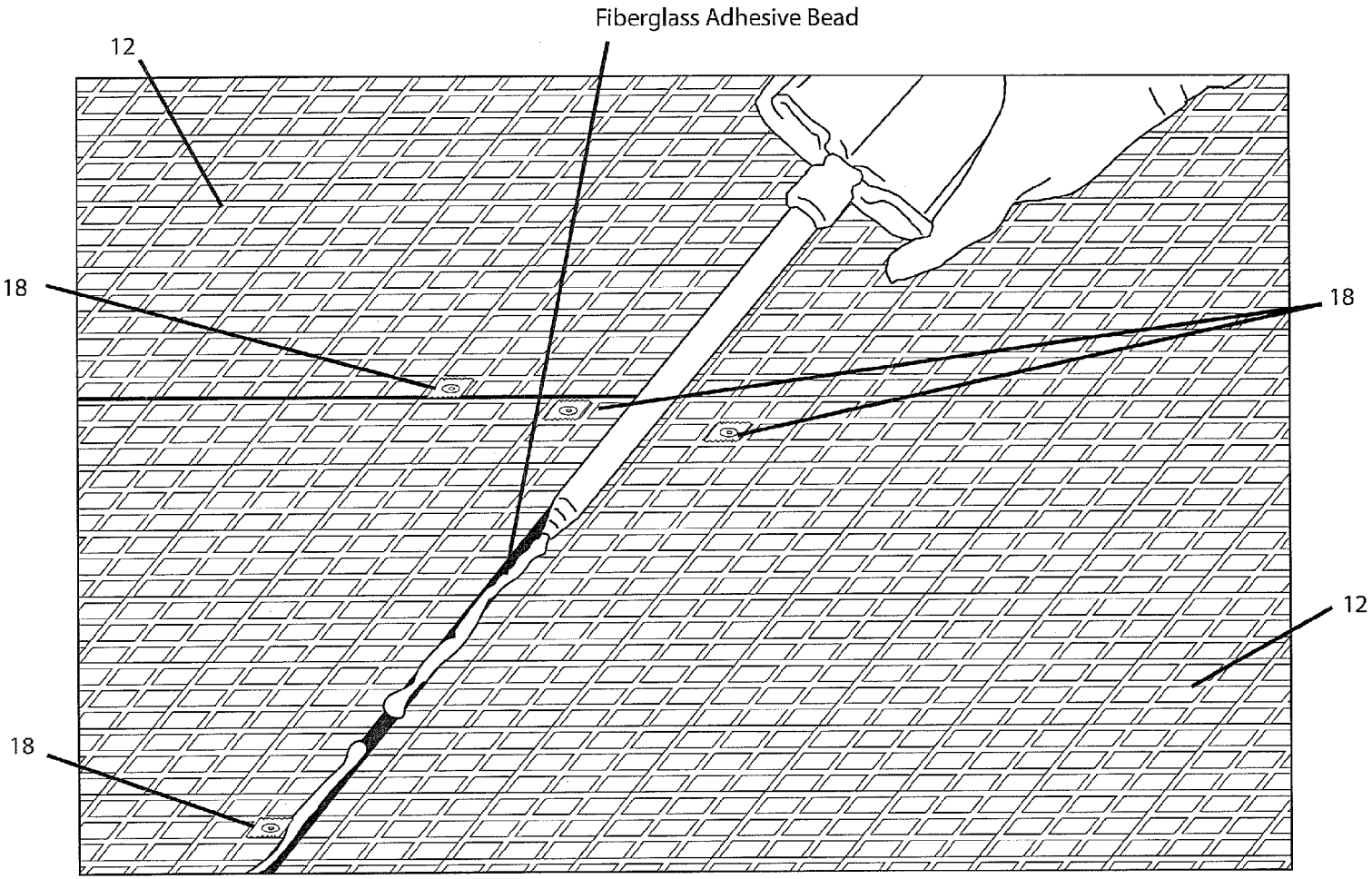

Stainless steel screws are then screwed through the openings 30 in each fastener, to secure the structural panels to the deck frame 16, as shown in FIGS. 6 and 7, FIG. 7 being a split view showing both a close up view of a single secured fastener/screw and a farther away view illustrating a wider area, with 5 connectors visible.

Figure 8:
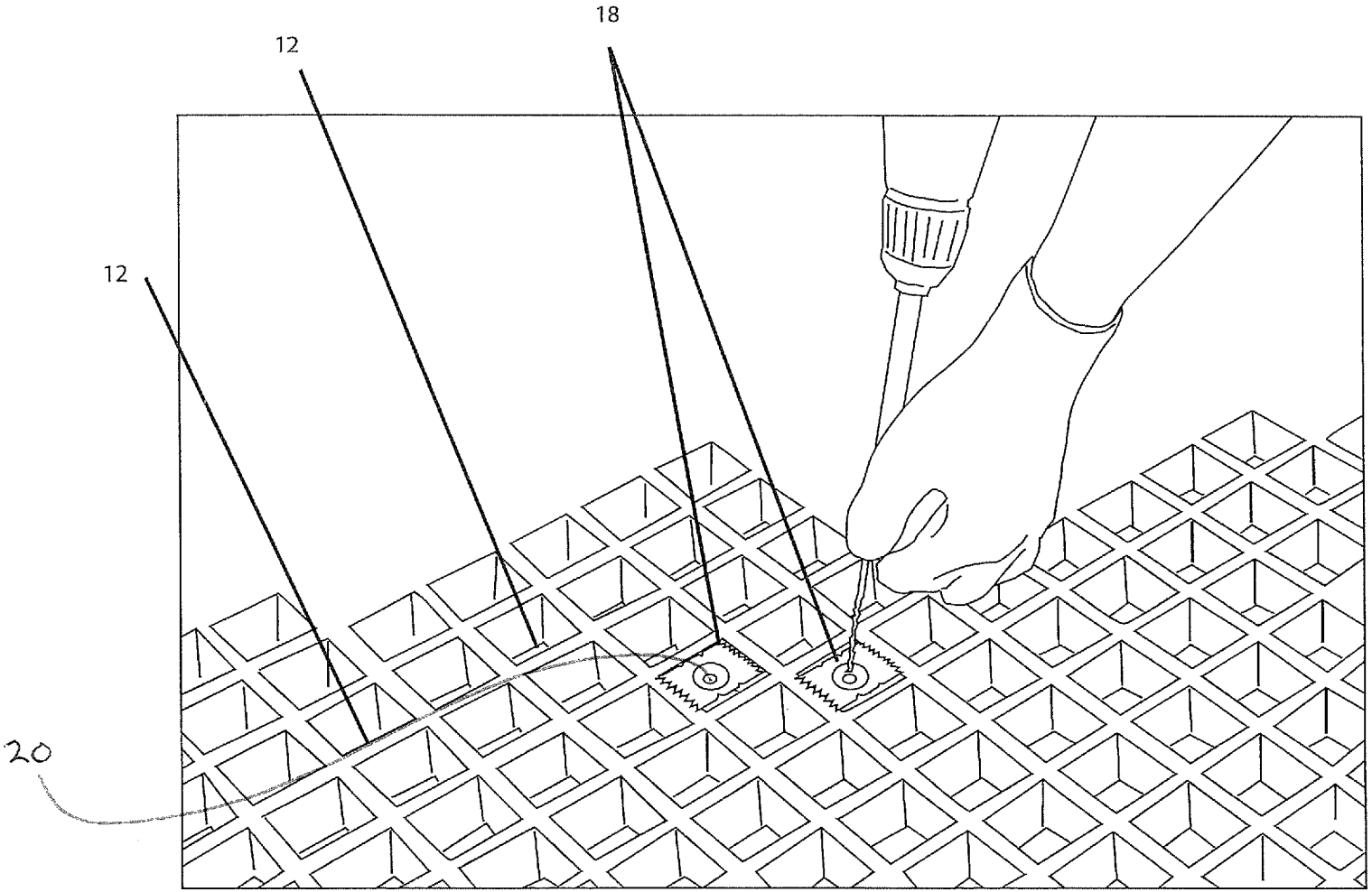
Figure 9:
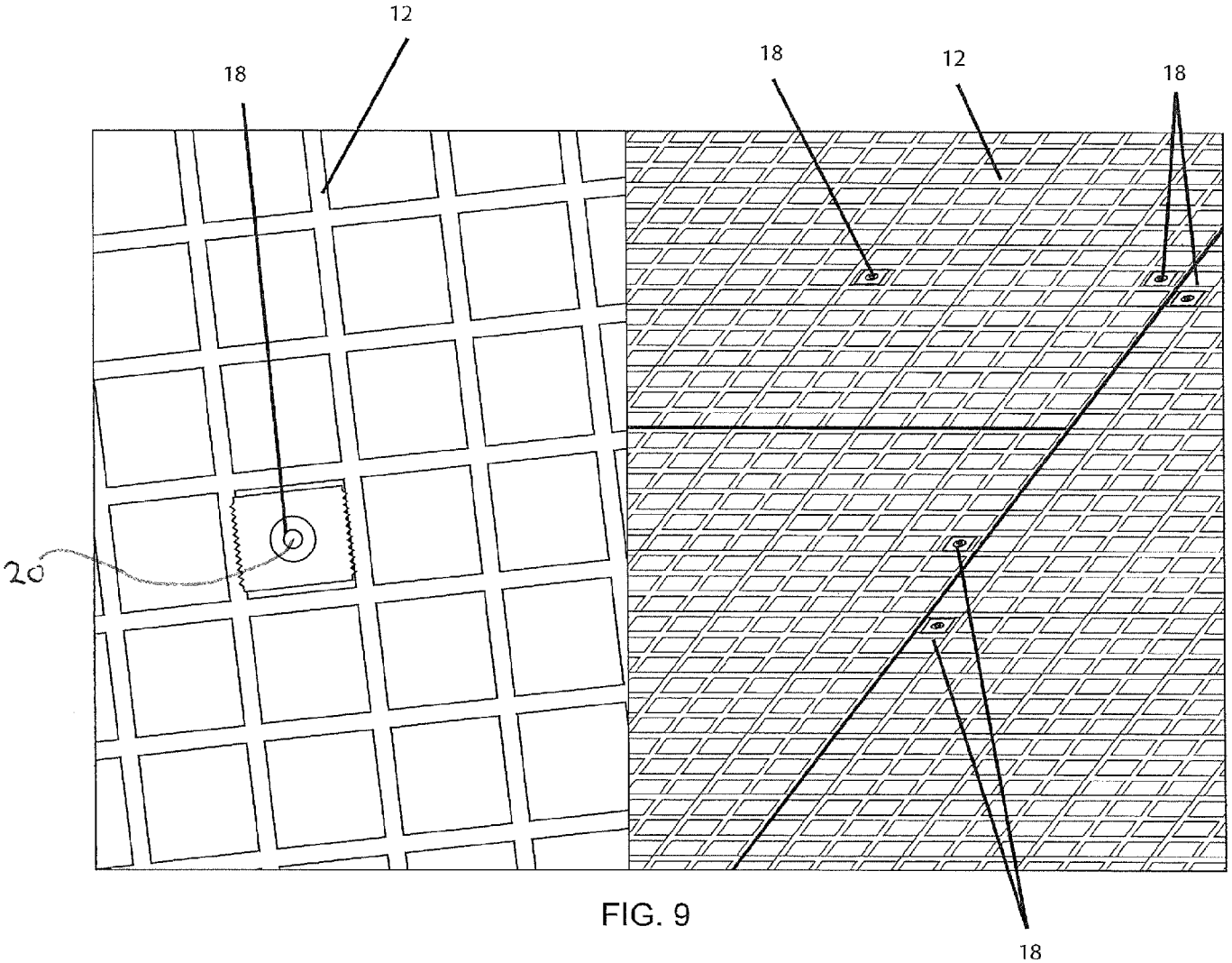
Figure 10:
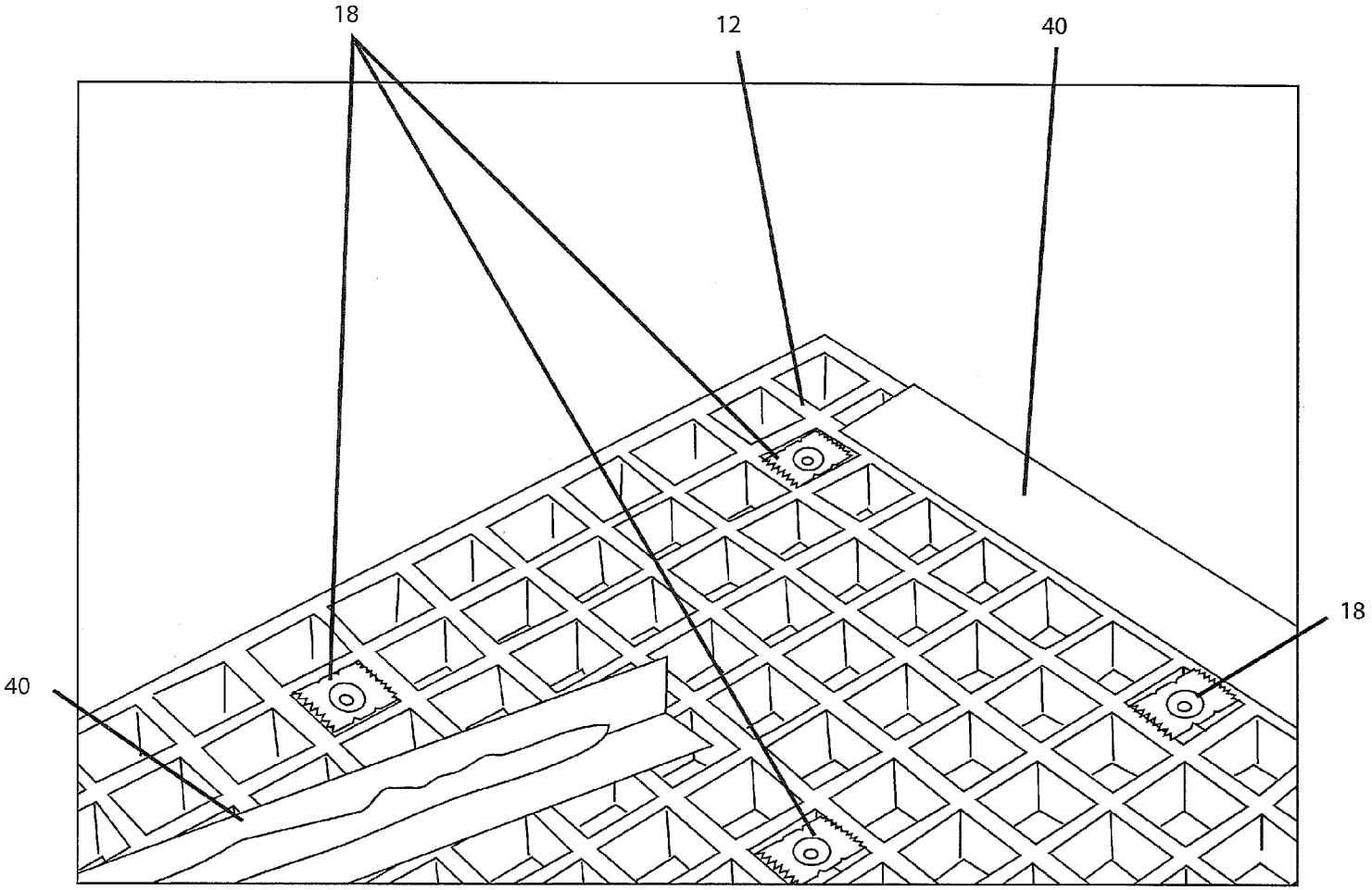
Figure 11:
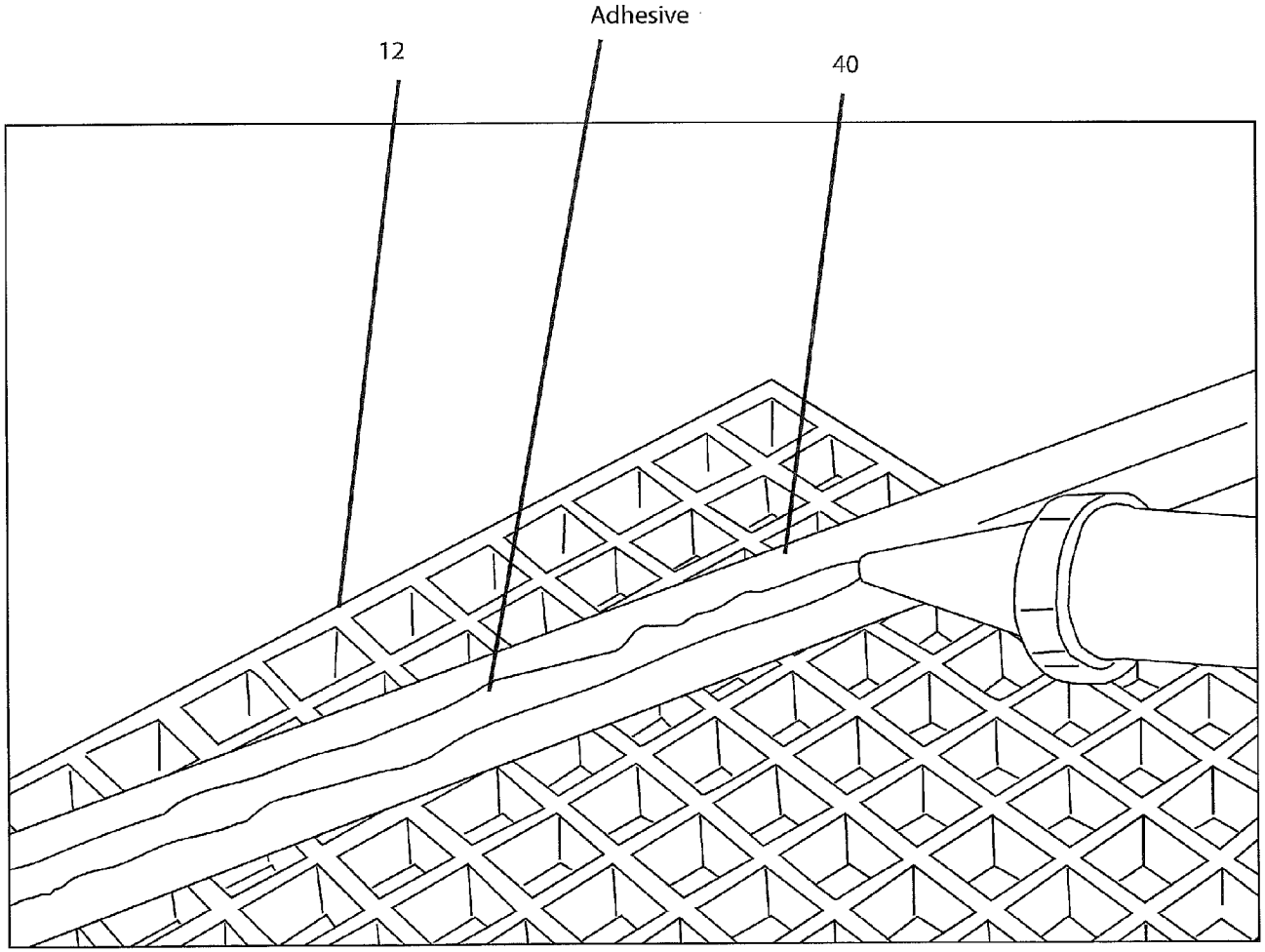
Figure 12:
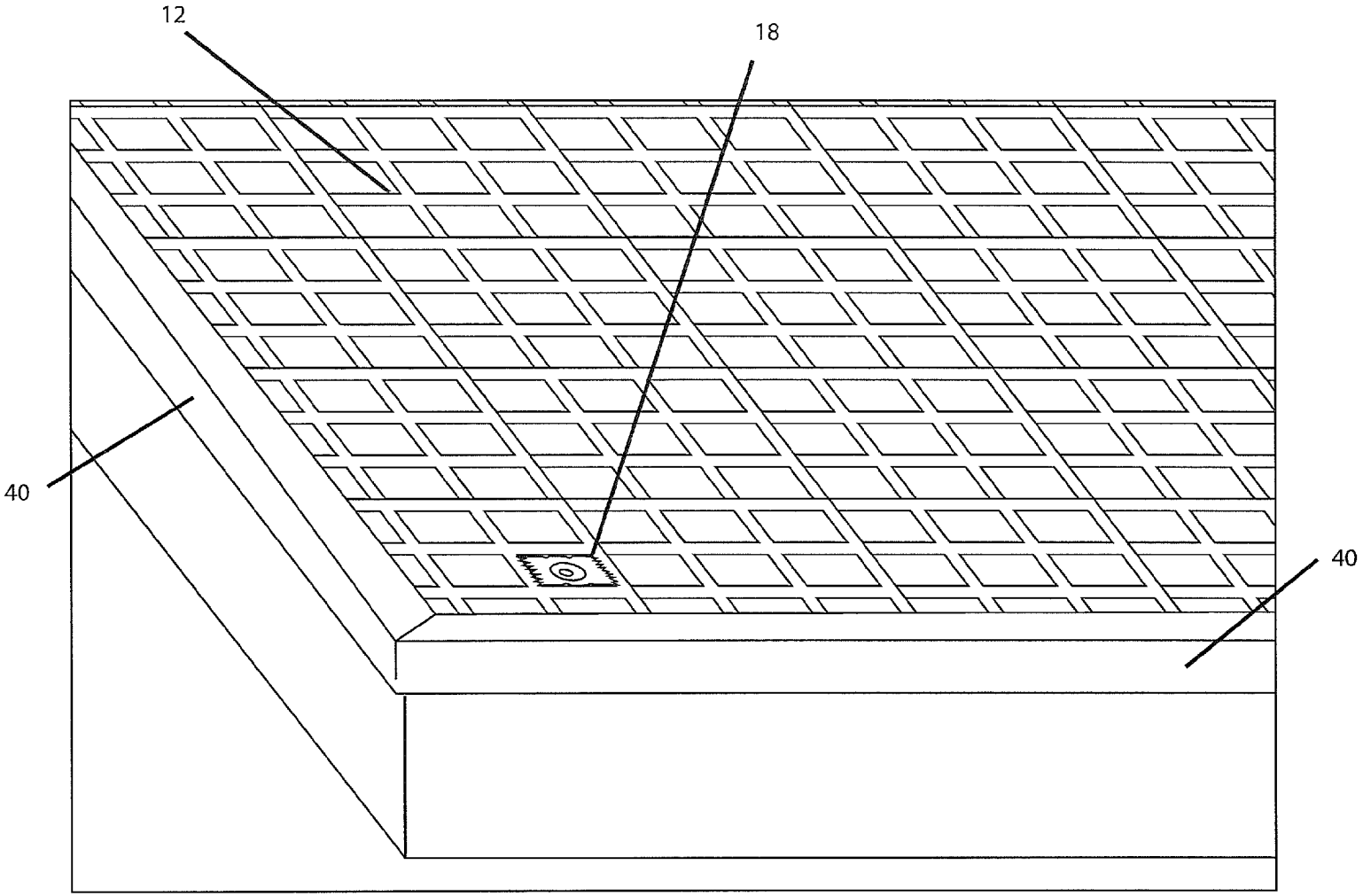
Figure 13:
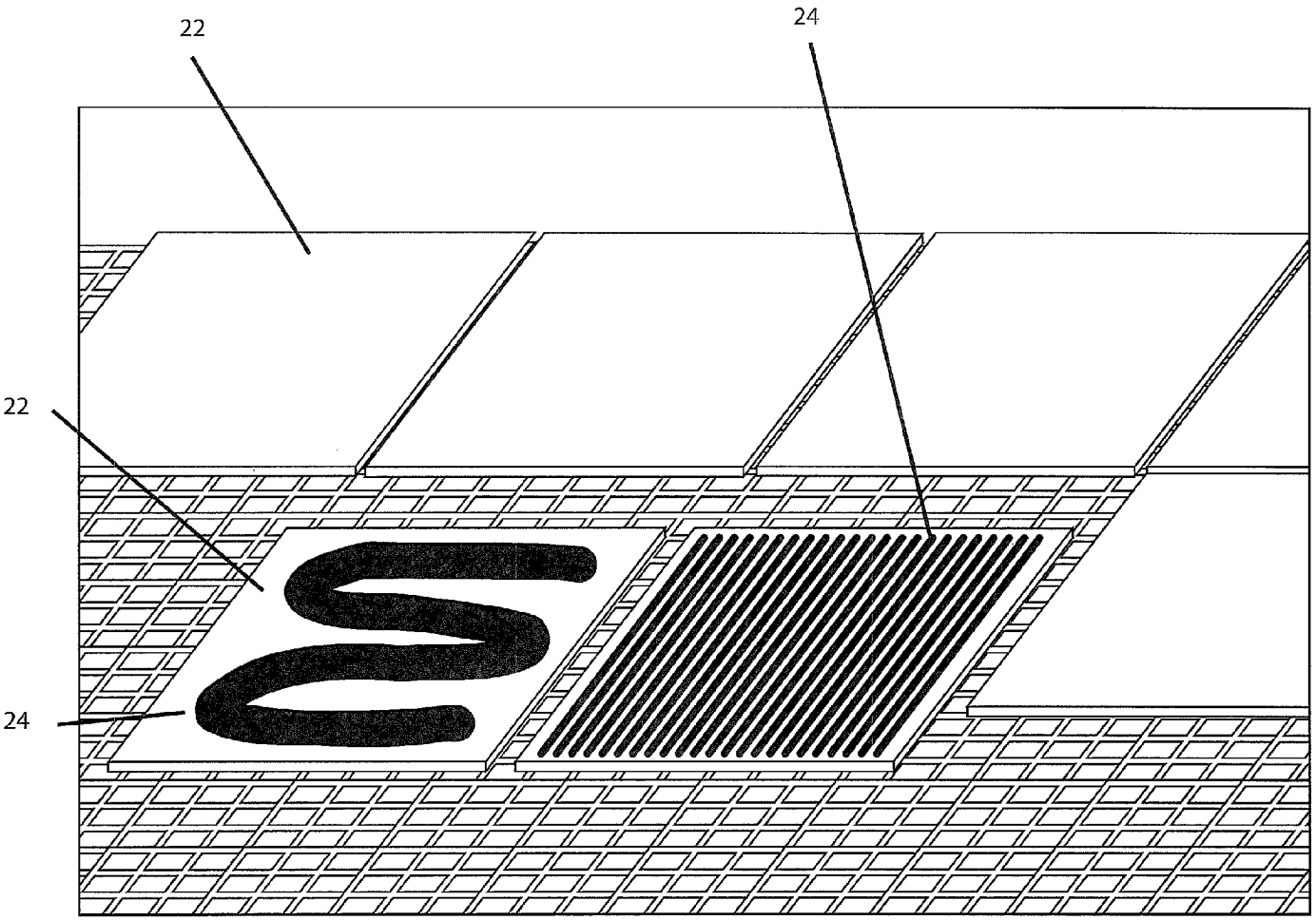
Figure 14:
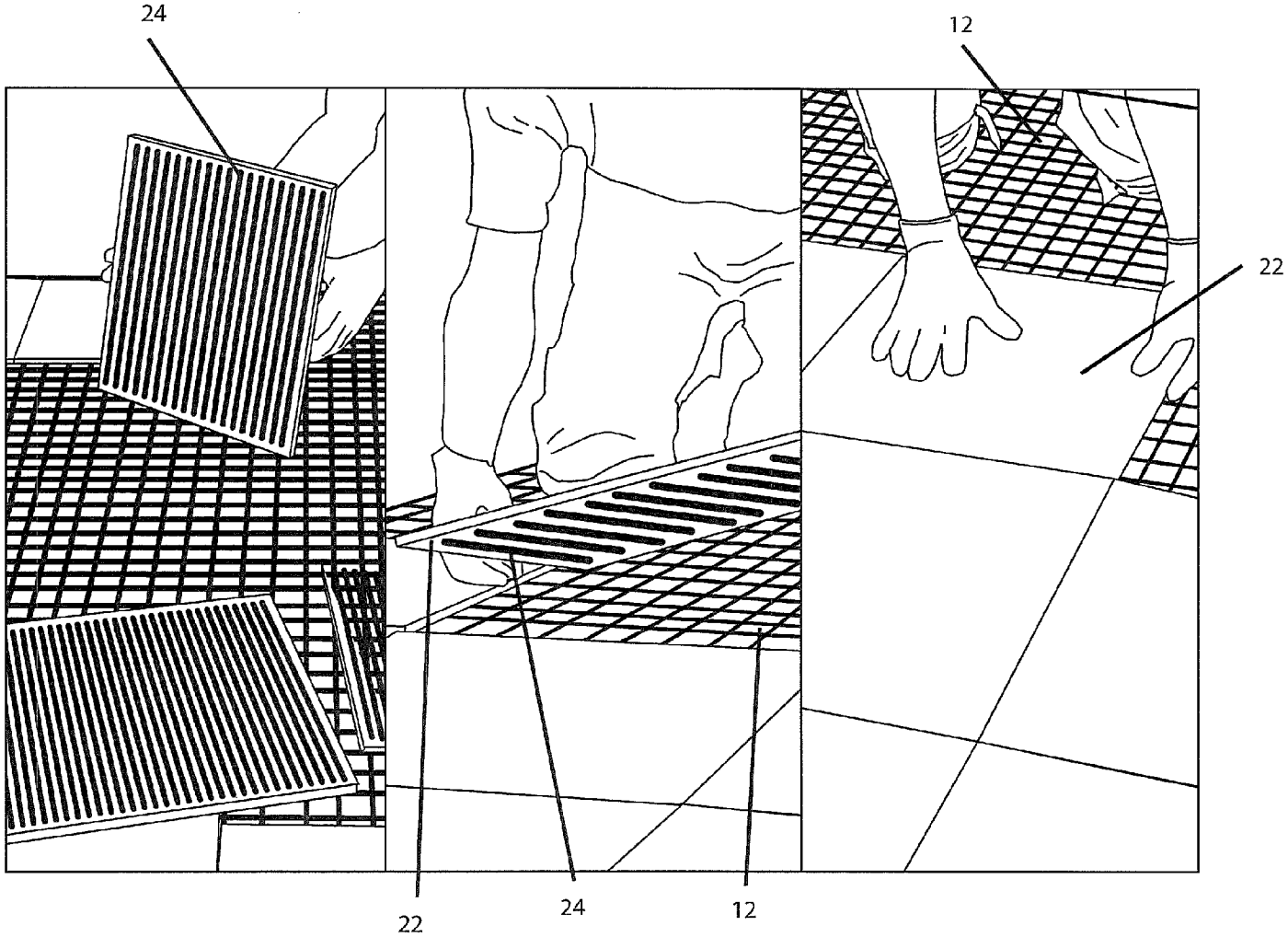

An edge trim 40 may now be applied to the peripheral edges of the assembled structural panel group, by cutting the trim to length and applying adhesive thereto (to the inside corners of the edge trim) and then mounting the edge trim to the edges of the panels (FIGS. 8-10). The edge trim can be, for example, metal edge trim and may be provided in a variety of colors and finishes, as desired for the aesthetic taste of the user.

Figure 15:
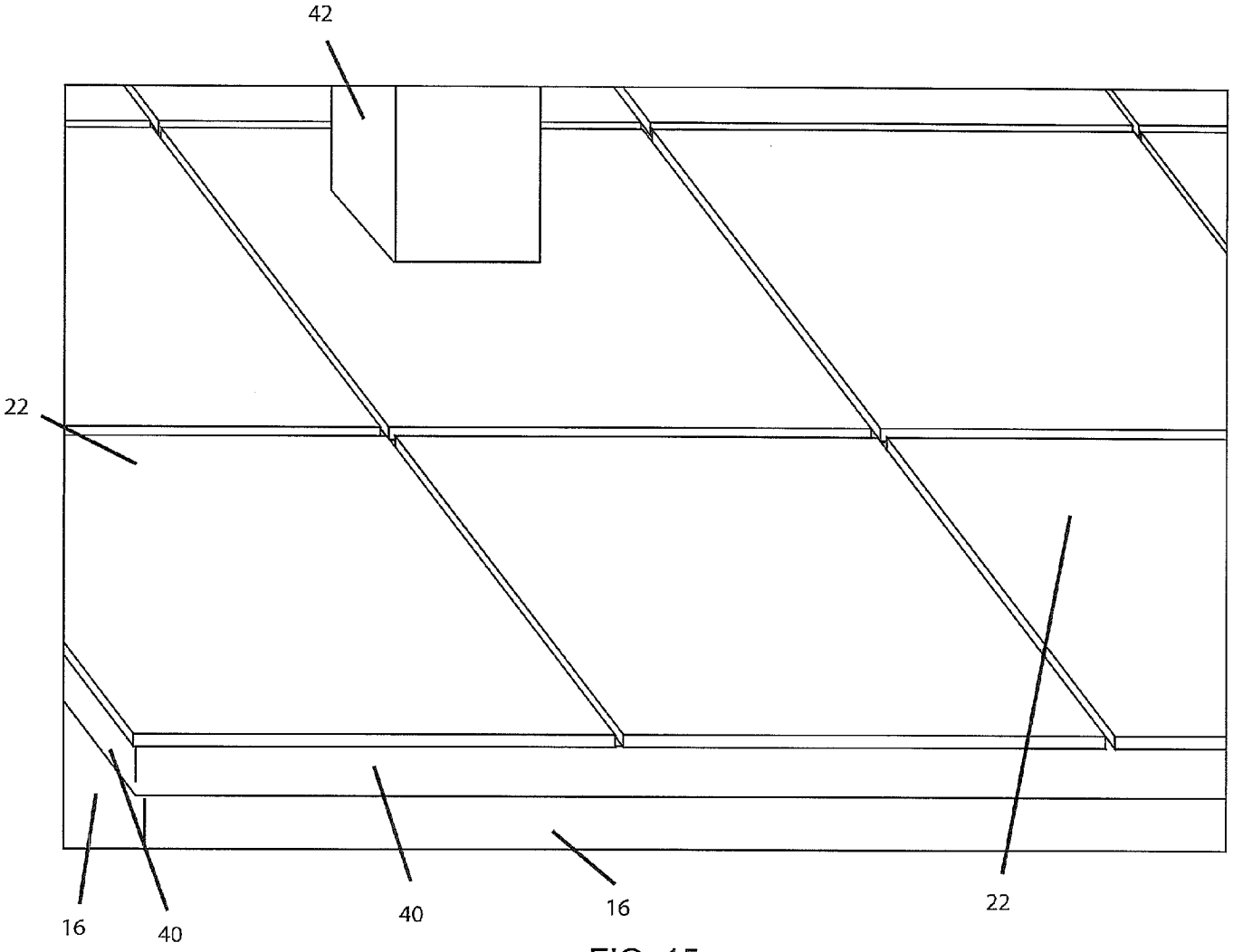

The surface material 22 is now prepared and applied to the structural panel, illustrated in FIGS. 11-14. In the illustrated embodiment, surfacing material 22 comprises quarried stone tiles having dimensions of 15¾ inch by 15¾ inch, and approximately 11/32nd inch thickness. The surface material tiles are first dry set and cut to fit around any obstacles 42 (a vertical post in FIG. 13). Next, an adhesive is applied to the back of the stones and spread with a notched trowel in the particular embodiment shown. The adhesive suitably comprises an elastomeric polymer. The surface material is now placed adhesive side down onto the structural panel surface, positioned suitably with 1/8th inch spacing between the tiles. The joints between tiles are not grouted, but are left open, allowing drainage and room for expansion and providing an appearance that is visually appealing. FIG. 15 illustrates a finished deck surface employing stone tiles as the surfacing material, with edge trim on the peripheral edges of the structural panel.

In an alternative embodiment, the bonding material 24 is provided in the form of a sheet membrane, not illustrated as it resides beneath the surfacing material shown in FIG. 15) such as an EPDM rubber or similar material, which is flexible and soft. The sheet is suitably 1/16th inch thick, of dimensions corresponding to those of the surfacing material 22, and is coated on both sides with a pressure sensitive contact adhesive. The sheet membrane is placed onto the surfacing material 22 and then the surfacing material is placed onto the structural panel 12. This alternative manner of adhering the material to the panel results in a flexible bond.

NOTE: This method of bonding stone/tile in exterior applications is very unique and could have some significant long-term value!!

Figure 16:
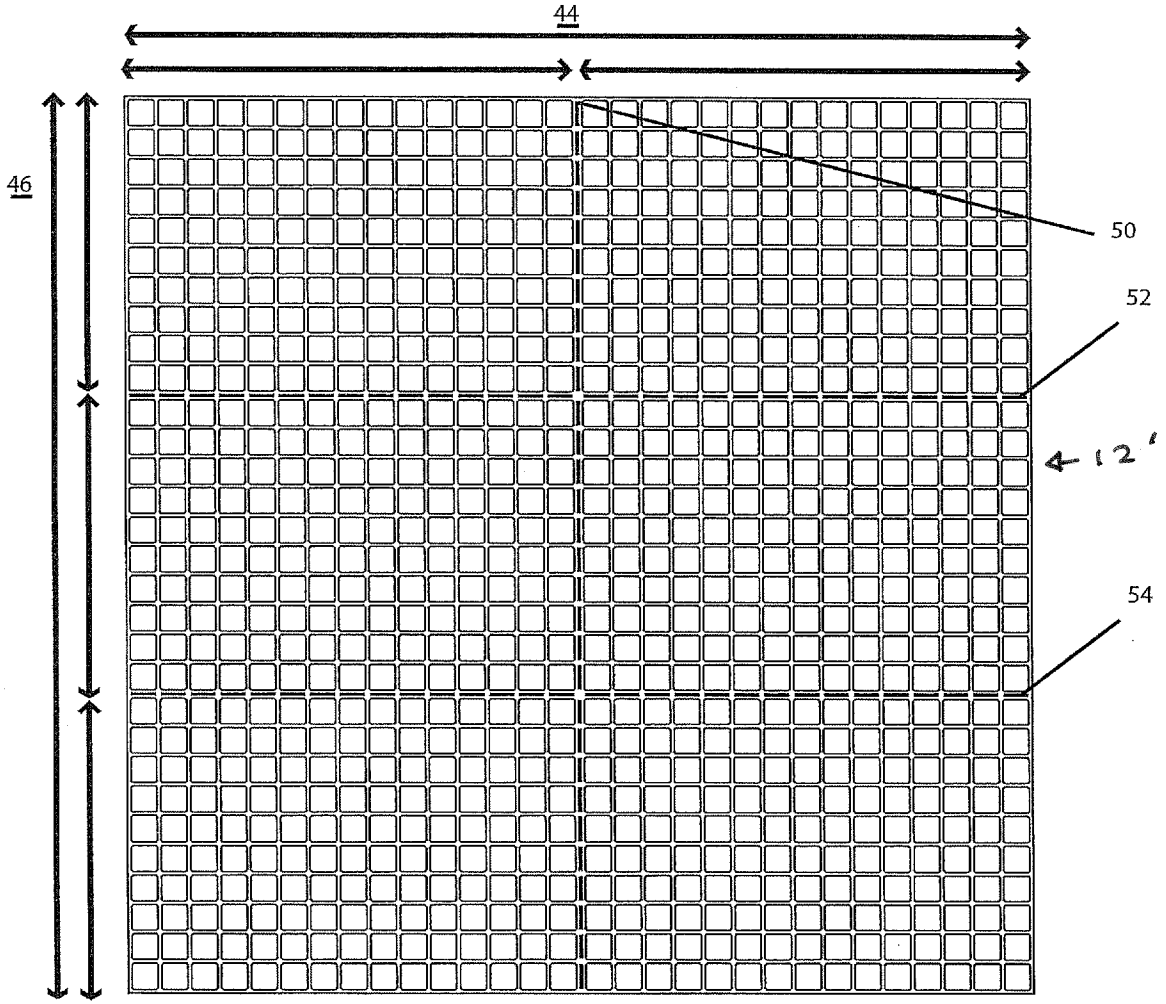
FIG. 16 is a view of an alternate structural panel.
Figure 17:
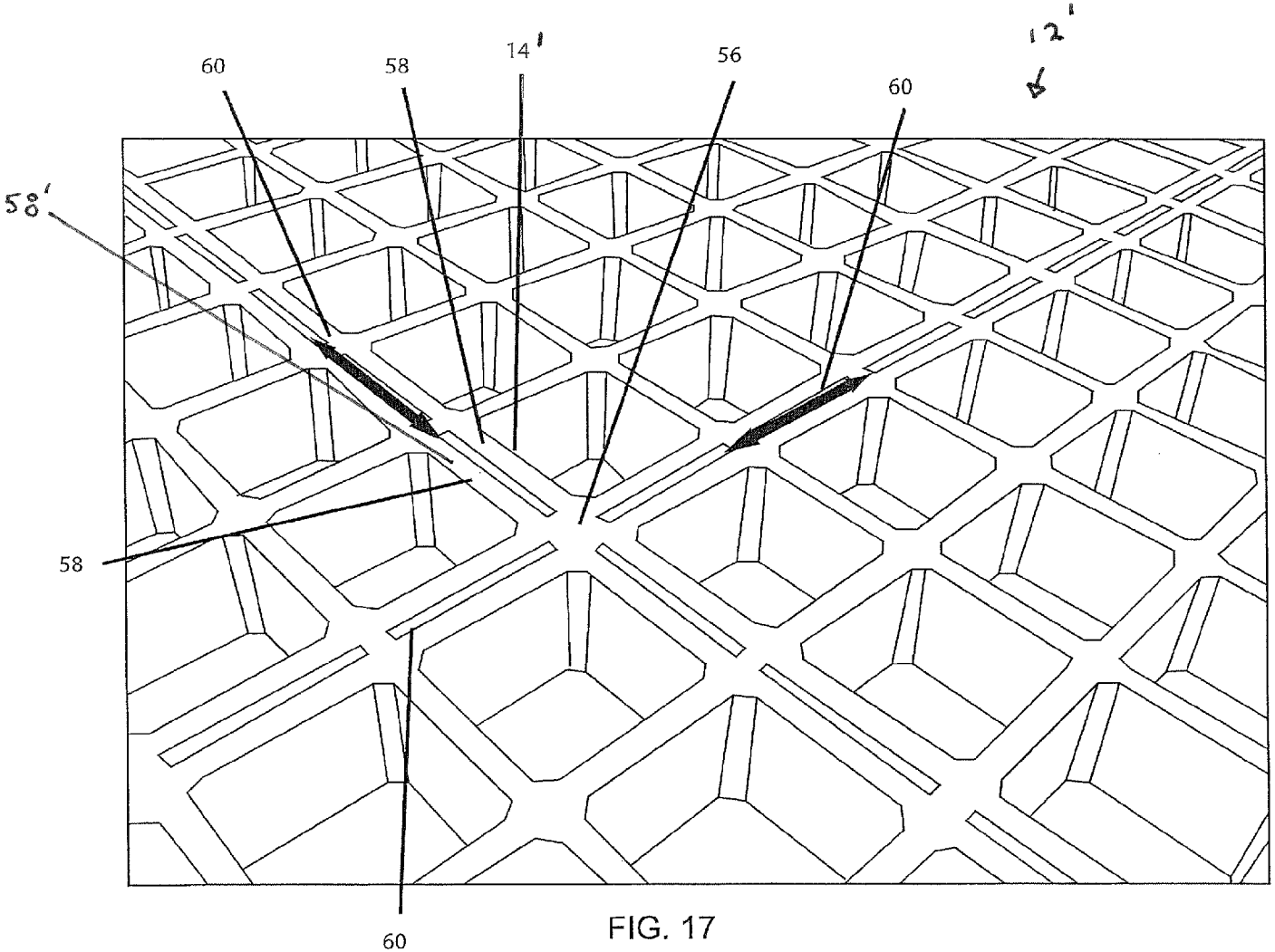
FIG. 17 is a close up view of an alternate structural panel.

FIG. 16 is a diagram of an alternative structural panel 12', while FIG. 17 is a close-up perspective view of a portion of a panel 12'. Panel 12' includes plural openings 14', which are substantially square in the illustrated configuration, provided in a grid-like pattern. The panel 12' is suitably 4 feet long in dimension of arrow 44 by 4 feet long in the dimension defined by arrow 46 illustrated embodiment. Approximately centrally of the panel spanning from edge to edge is a cut line 50, defined by a double sidewall 58, 58' between openings 14' adjacent one another along the cut lines, with a central opening 60 defined therein. A solid portion 56 is provided across the cut line at regularly spaced intervals, the interval being the size of the spacing of the openings in the illustrated embodiment, The cut line 50 provides an easy to cut dividing line along the panel providing sub-dividable portions to easily cut the panel (or a portion thereof) into 2 parts or to cut out a standard size portion. Along the other direction of the panel, a pair of cut lines 52 and 54 are defined, suitably evenly spaced, to provide an easy to cut line defining 3 sub-dividable portions of the panel in that direction for sub-dividing the panel in to 3 sub-portions. In the illustrated embodiment, the cut lines enable easy cut lines with 24 inch and 16 inch spacing, which are typical joist spacing employed in deck construction, for example. Other dimension may be employed as desired to provide easy to cut lines along typically desired spacing. Note that cutting down between the double bars with a saw blade allows the panels to be cut down to 16" and 24" standard USA building dimensions a full perimeter bar.

In situations where the underlying surface is sloped, uneven, has protuberances or penetrations it is desirable to cheaply and securely raise the sub flooring system to a height that allows it to be horizontally planar or float just above a waterproofing deck surface. FIGS. 18-30 illustrate embodiments utilizing pipe stanchions and support plates for use to provide a terrace surface, optionally in a pedestal configuration.

Figure 18:
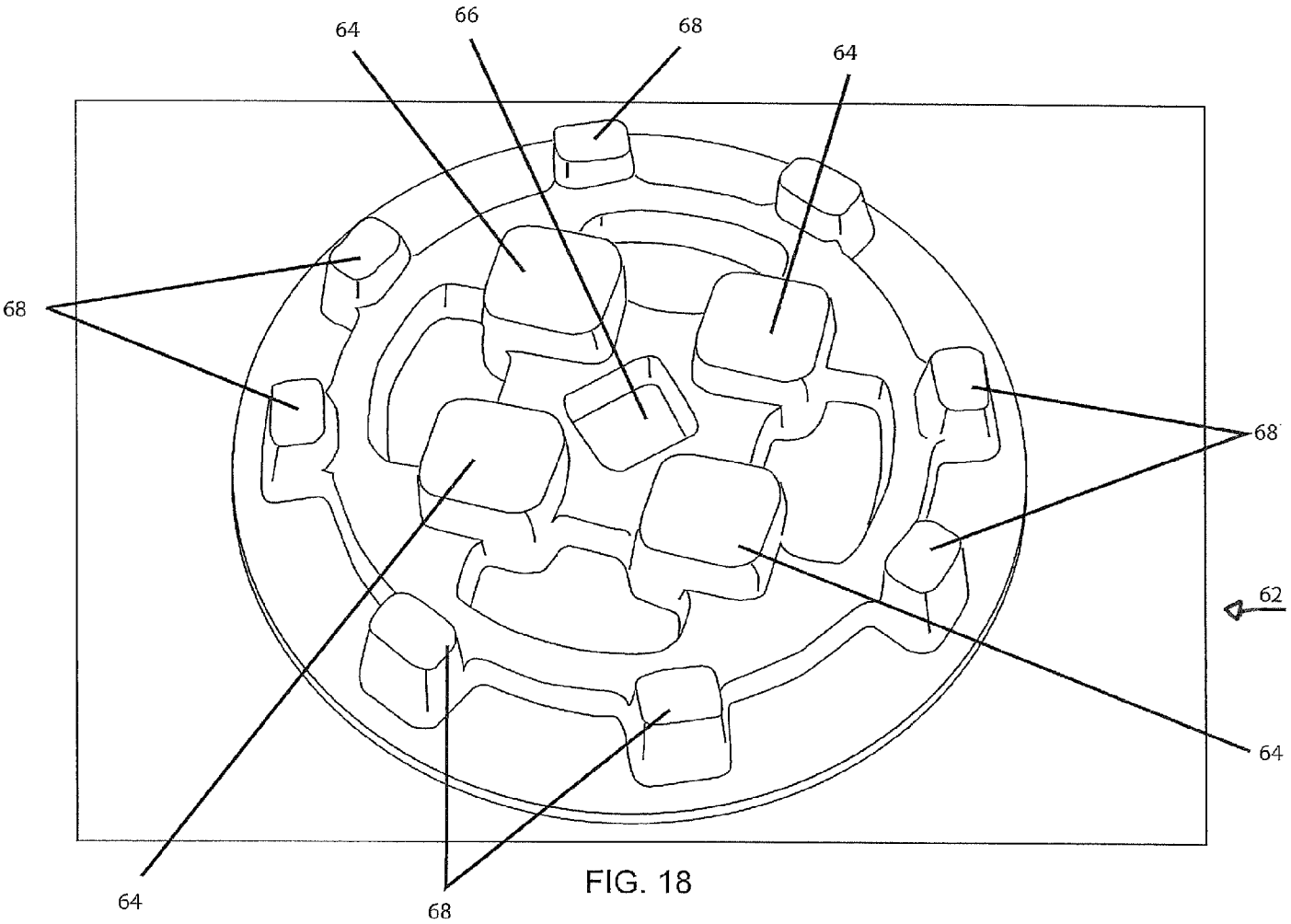
FIG. 18 is a perspective view of a connector for connecting adjacent panels and/or mounting panels to an adjustable pedestal support for elevating the panel.

FIG. 18 is a perspective view of a stanchion support plate for connecting adjacent panels and/or for mounting panels to a stanchion under support. The stanchion support plate 62 is a disk-shaped member having 4 central raised members 64 suitably of substantially square profile when viewed from above. Centrally of the members 64 is a recessed portion 66. Radially positioned about the edge of the stanchion support plate 62 are 8 raised members 68. Member 64 and 68 are of size and shape so as to be receivable in openings 14 or 14' of panels 12, 12', and as discussed below, to engage with alternate panel 70. In a particular embodiment, stanchion support plate 62 has a diameter of 6 inches.

Figure 19:
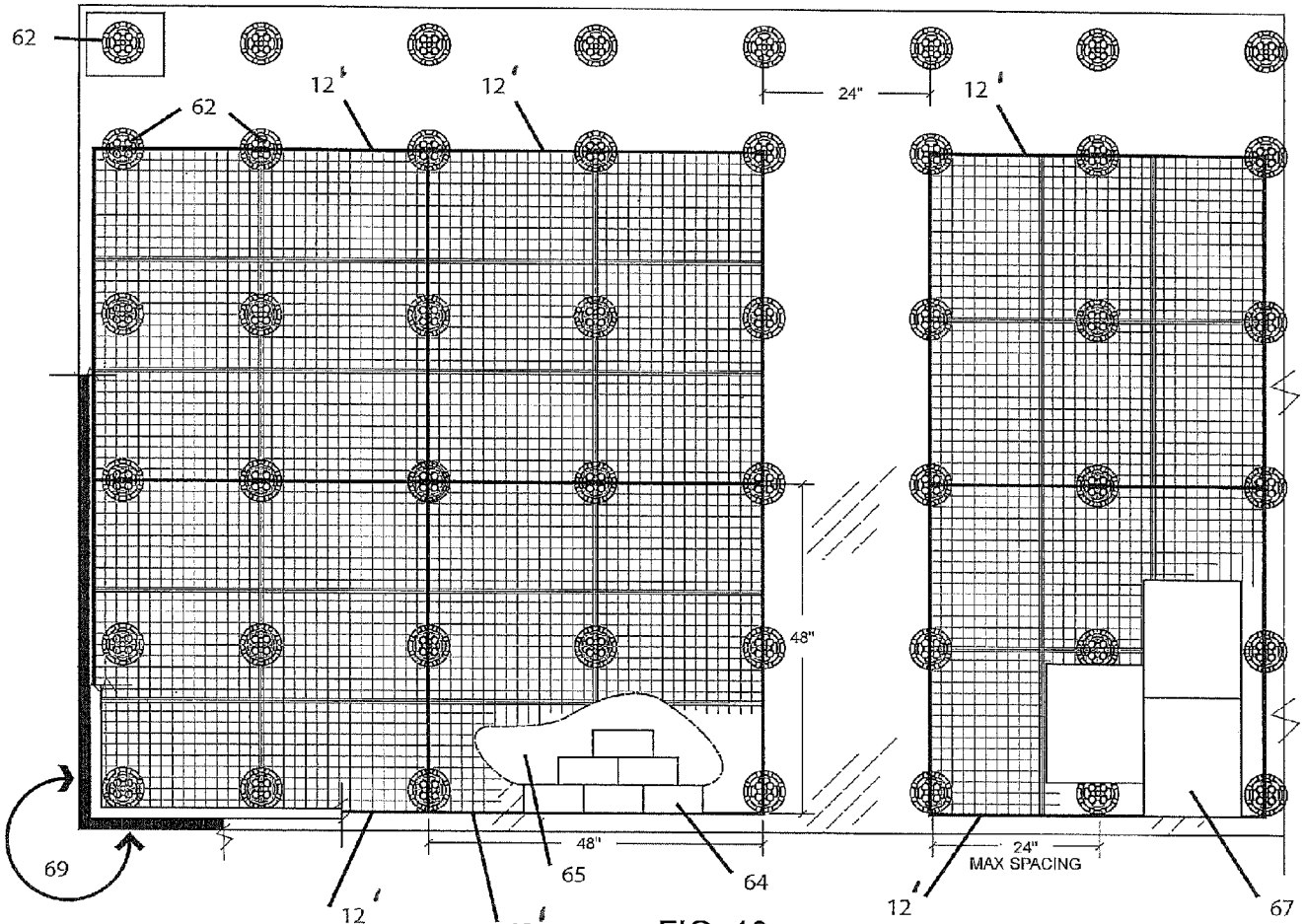
FIG. 19 is a top view of an installation of plural panels using plural connectors.

FIG. 19 is a top view of an installation of plural panels 12' using plural stanchion support plates 62. In the illustration of FIG. 19, at the leftmost edge of the installation of panels 12', the stanchion support plates 62 are moved inwardly slightly from the edge of the panel, illustrating the case where there is some obstruction, for example, that would prevent the stanchion support plate from extending beyond the left most edge of a panel, as contrasted with the rightmost portion of the drawing, where the stanchion support plates are able to extend beyond the edge of the panels, and are accordingly positioned.

There are 6 panels 12' shown in FIG. 19, with a portion of one panel having illustrative pavers or bricks 64 placed thereon and dry-laid over optional construction fabric (nonwoven) 65 (perimeter pavers being secured with adhesive), and a portion of another panel 12' having tiles or stones 67 placed thereon, either secured to the panels with adhesive applied to the tiles or stones or via sheet adhesive. A metal trim 69 may be applied to peripheral edges of the panels, a portion being illustrated in FIG. 19. The connectors may be floating or secured to the underlying layer.

Figure 20:
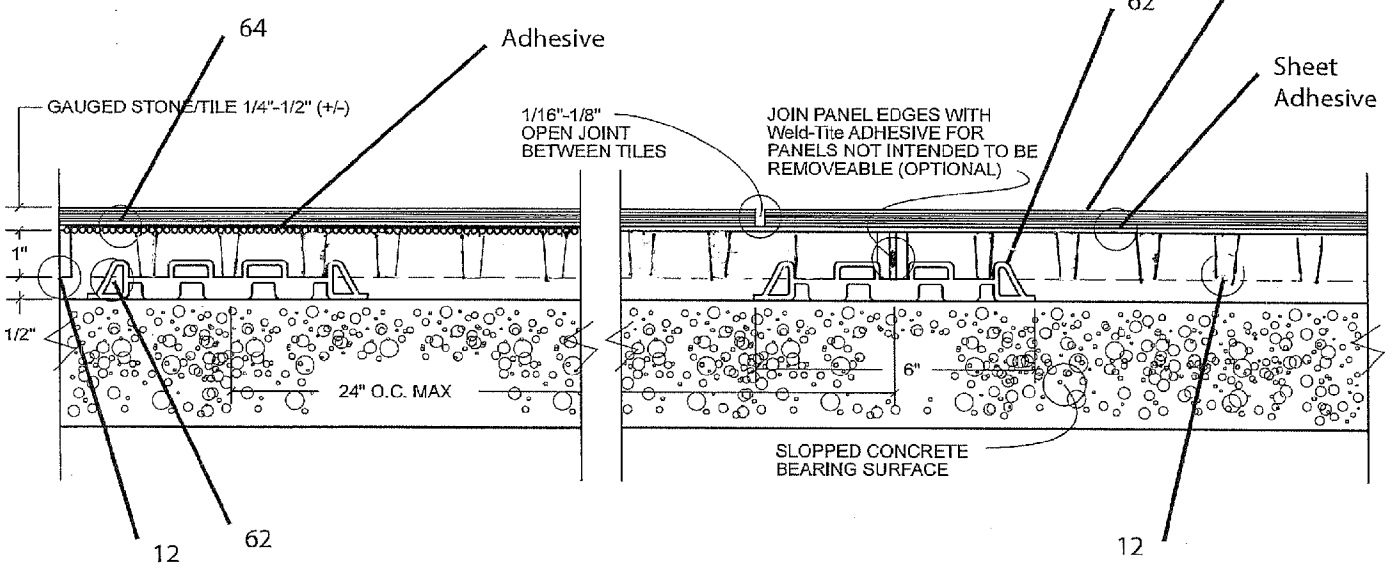
FIG. 20 is a side view of an installation where connectors are floating.

FIG. 20 is a side view of an installation where stanchion support plates 62 are floating (i.e. not secured to any base or substrate) on a concrete base, for example.

Figure 21:
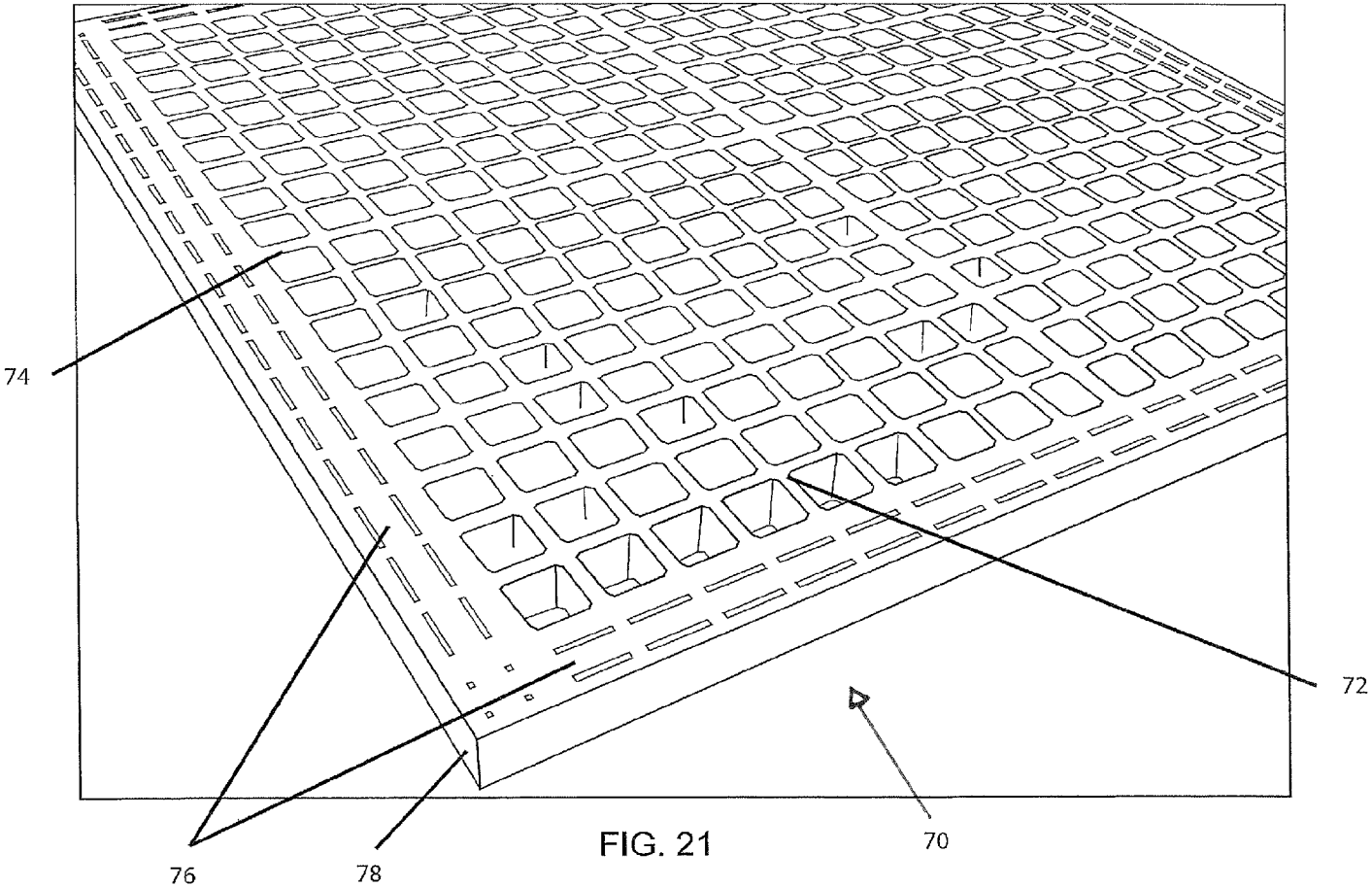
FIG. 21 is a perspective view of a panel for use in pedestal mounting configurations.

FIG. 21 is a perspective view of a panel 70 for use in pedestal mounting configurations. The panel 70 is suitably 31⅝ inch by 31⅝ inch dimensions in a particular embodiment and 1.25 inch thickness. Panel 70 includes central portions 72, 74 that define thicker edges of the openings along portions 72, 74, subdividing the panel into 4 equal size quadrants. The edges 76 of the panel are wider (as contrasted with panels 12, 12' which have edges with substantially the same width as the portion between any 2 adjacent openings).

Figure 22:
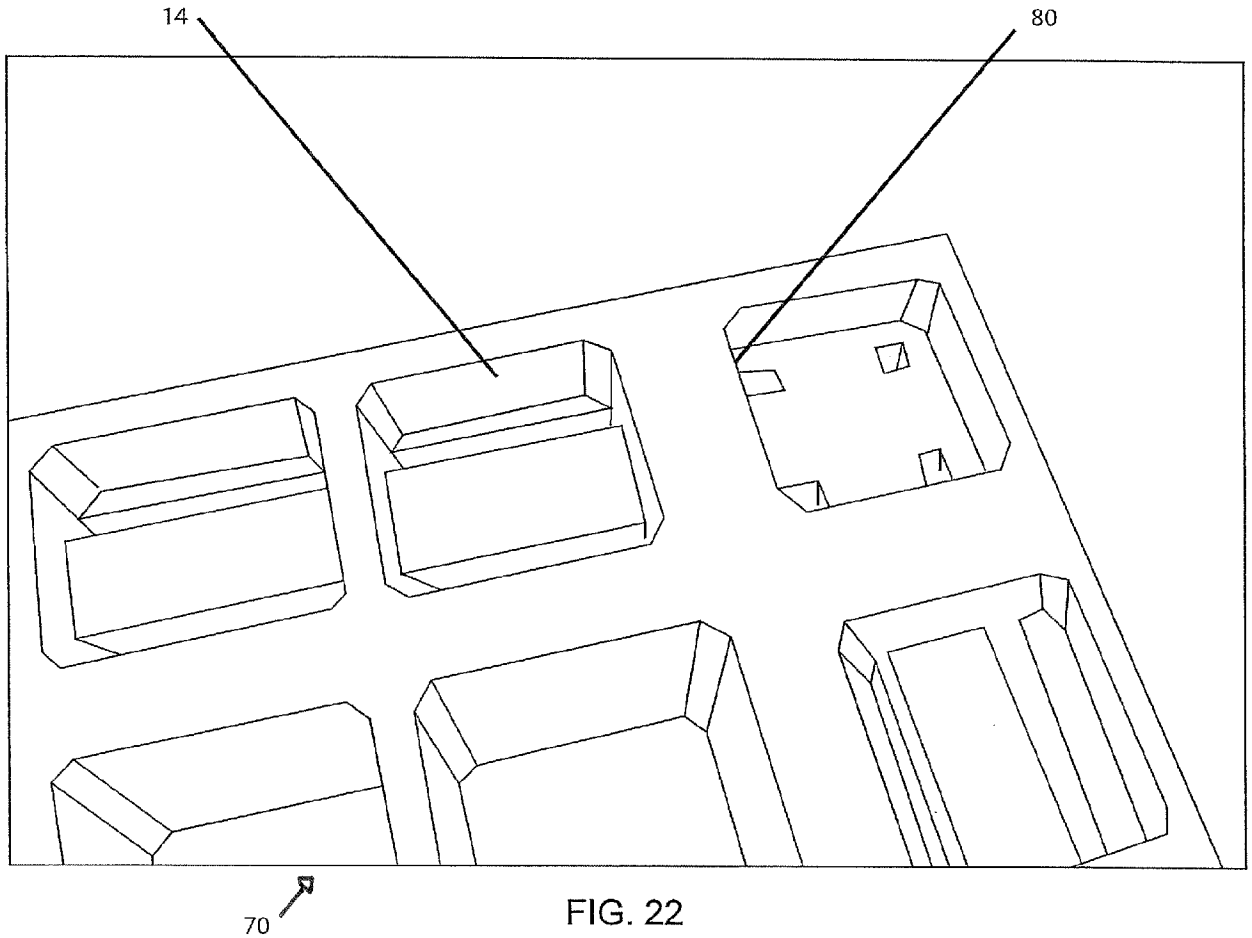
FIG. 22 is a view of underneath the corner of a panel.

FIG. 22 is a view of underneath a corner of panel 70, wherein a recessed region 80 is defined, of depth and shape profile so as to correspond to the height and shape of raised members 64 of stanchion support plate 62.

Figure 23:
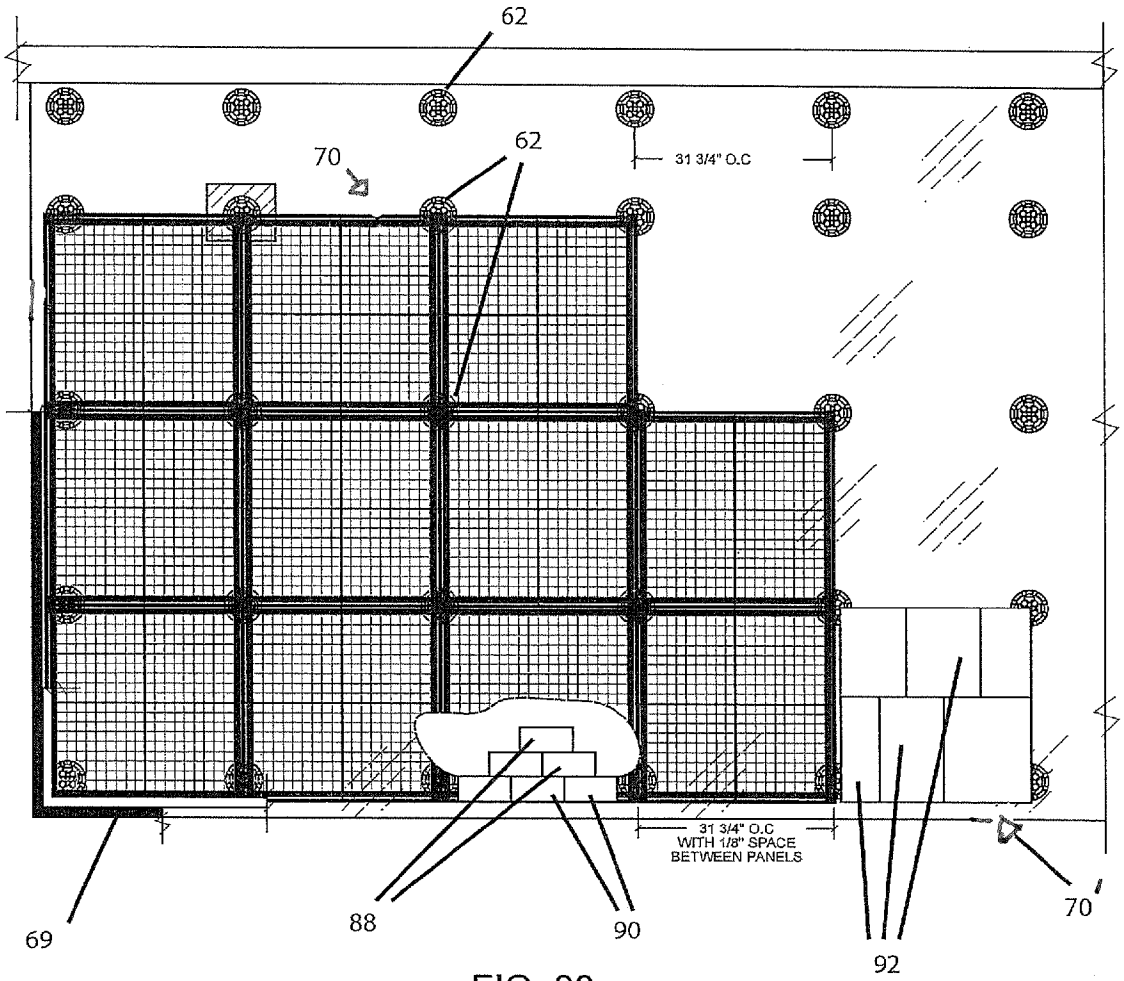
FIG. 23 is a top view of an installation of plural panels using plural connectors.

FIG. 23 is a top view of an installation of plural panels 70 using plural stanchion support plates 62. In the illustration of FIG. 23, at the leftmost edge of the installation of panels 12', the stanchion support plates 62 are moved inwardly slightly from the edge of the panel, illustrating the case where there is some obstruction, for example, that would prevent the stanchion support plate from extending beyond the left most edge of a panel, as contrasted with the rightmost portion of the drawing, where the stanchion support plates are able to extend beyond the edge of the panels, and are accordingly positioned. The stanchion support plates 62 are suitably positioned to be 31¾ inches on center, placed so as to be positioned at intersection points of any adjacent panels and at the corners of any 4 adjacent panels.

Figure 24:
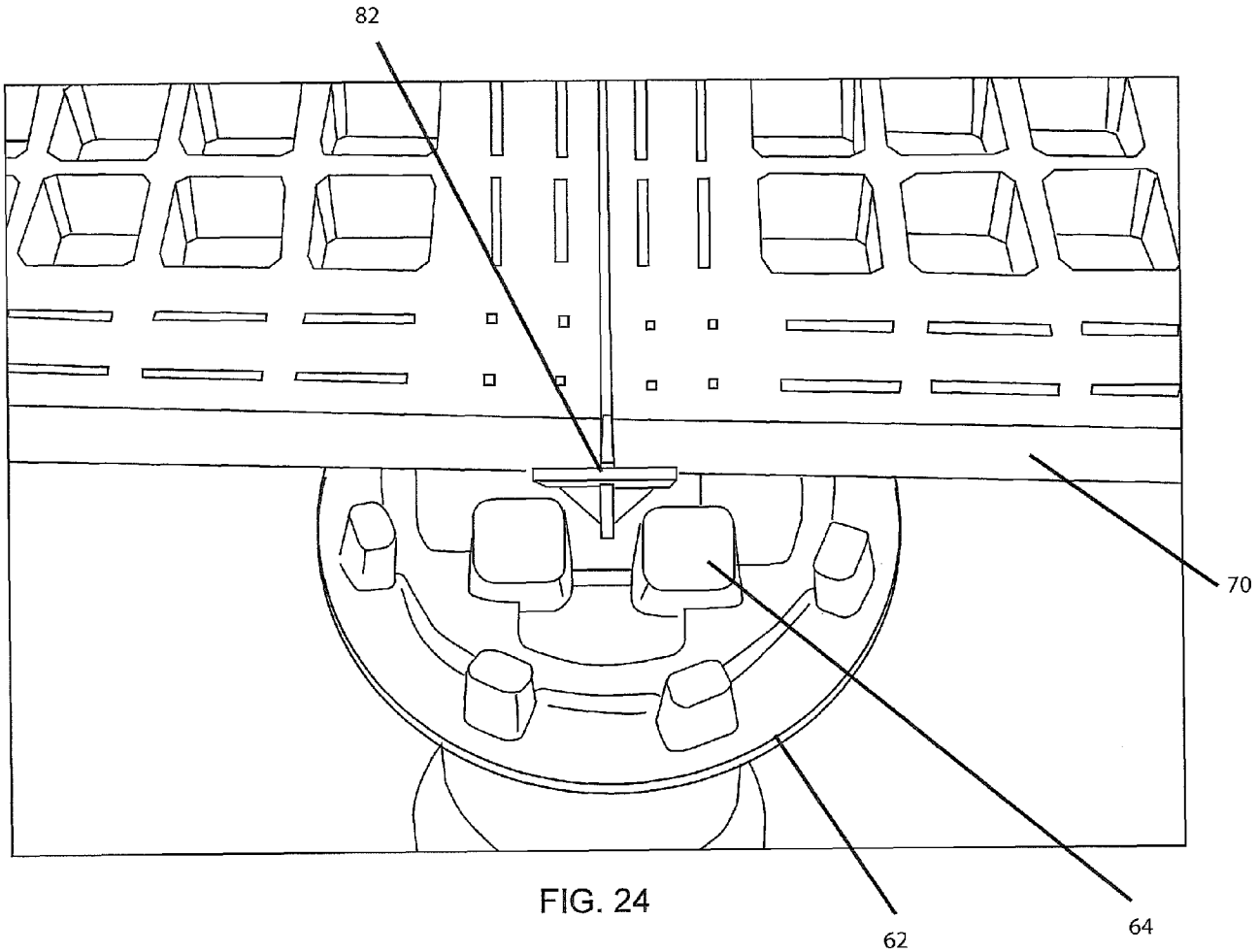
FIG. 24 is a perspective view of two adjacent panels positioned on a connector disk.
Figure 30:
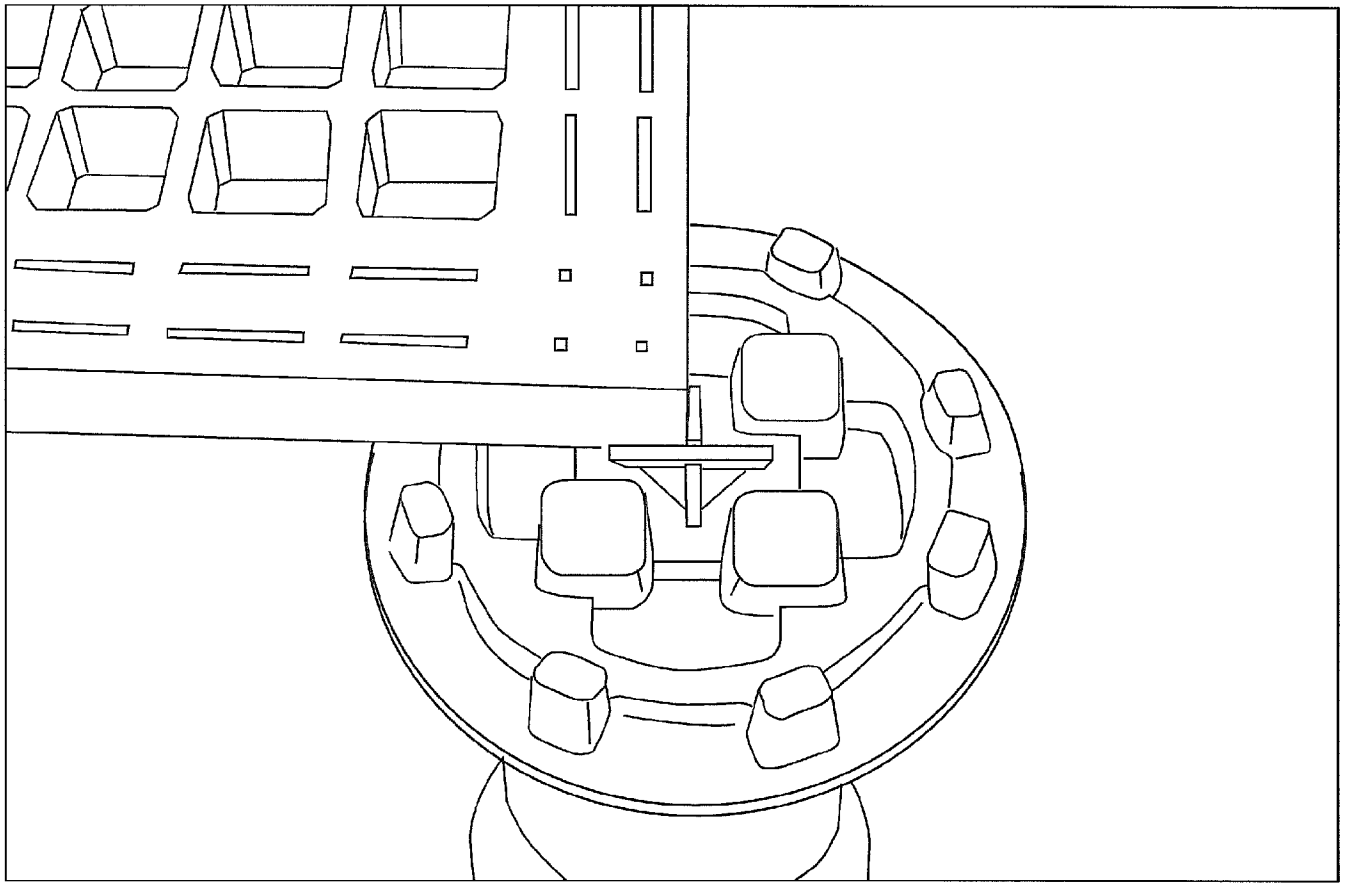
FIG. 30 is a top perspective view of a panel mounted on a connector disk, with a support pipe and bottom connector disk, providing a raised deck portion for mounting of pavers, stones or tiles for example.

Referring to FIGS. 24 and 30, a perspective view of two adjacent panels 70 positioned on a stanchion support plate 62, a spacer/aligner member 82 is received in recessed portion 66 of the disk 62 and acts to space adjacent panels 70 with approximately ⅛ inch between. Portions 64 are received in recessed region 80 to secure the panels to the stanchion support plate.

Figure 25:
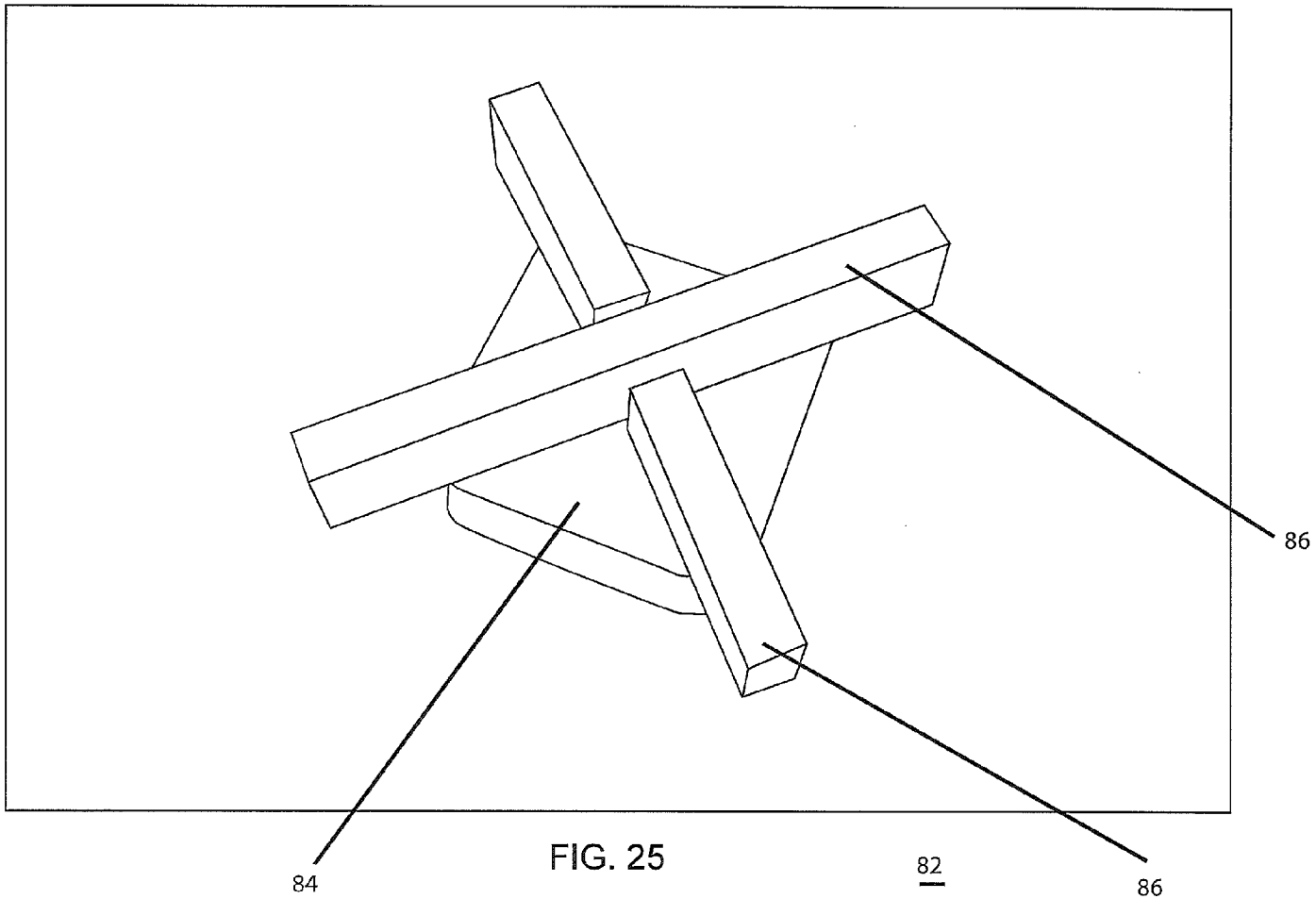
FIG. 25 is a top perspective view of a spacer/aligner.

FIG. 25 is a top perspective view of spacer/aligner 82, wherein a lower portion 84 is of a shape and profile to be received within portion 66 of a stanchion support plate 62, and upper arm portions 86 define the alignment and spacing of corners of adjacent panels 70.

Referring again to FIG. 23, field pavers 88 may be dry-laid on the panels 70 over optional nonwoven construction fabric. Edge pavers 90 in this configuration would be glued to the panels 70 with adhesive. Stones or tiles 92 can be adhered to the panels 70 with adhesive applied to the panels individually or with sheet adhesive. The stone/tile 92 can be fit to the individual panels 70 edges so that the panes can be removed at a later time if desired, FIG. 23 showing one panel 70' being so fit with stone/tile.

Figure 26:
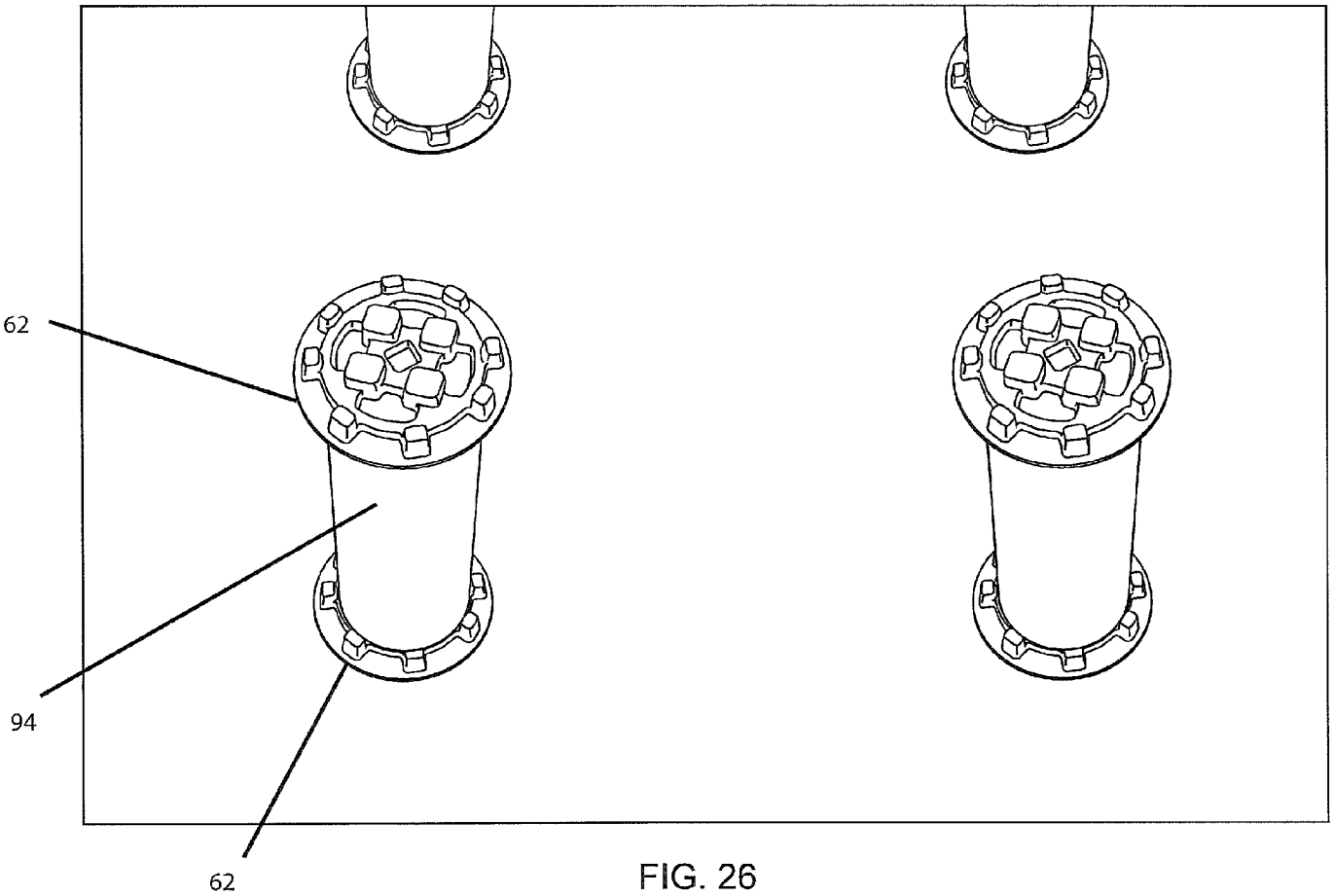
FIG. 26 is a top perspective view illustrating use of the connector disk and pipes to provide an elevated mounting for panels.

FIG. 26 is a top perspective view illustrating use of the stanchion support plate 62 in connection with stanchions 94 (which are preferably four inch nominal schedule 40 ABS pipe sections) to provide an elevated mounting for panels 70. The spacing and configuration of raised members 68 on stanchion support plate 62 are such that lower end of stanchion 94 is received on the support plate 62, inwardly of the raised member 68, for mounting of the support plate 62 to the pipe. The lower stanchion support plate provides a bottom mounting of the stanchion 94. On the top of stanchion 94, a second stanchion support plate 62 is mounted, to form a pedestal, whereby the top of the second stanchion support plate 62 is thereby positioned to receive panels 70. Plural stanchions 94 and connectors are positioned to define a mounting field for plural panels 70, providing a raised deck portion for mounting of pavers, stones, or tiles, for example, as shown in FIG. 30.

Figure 27:
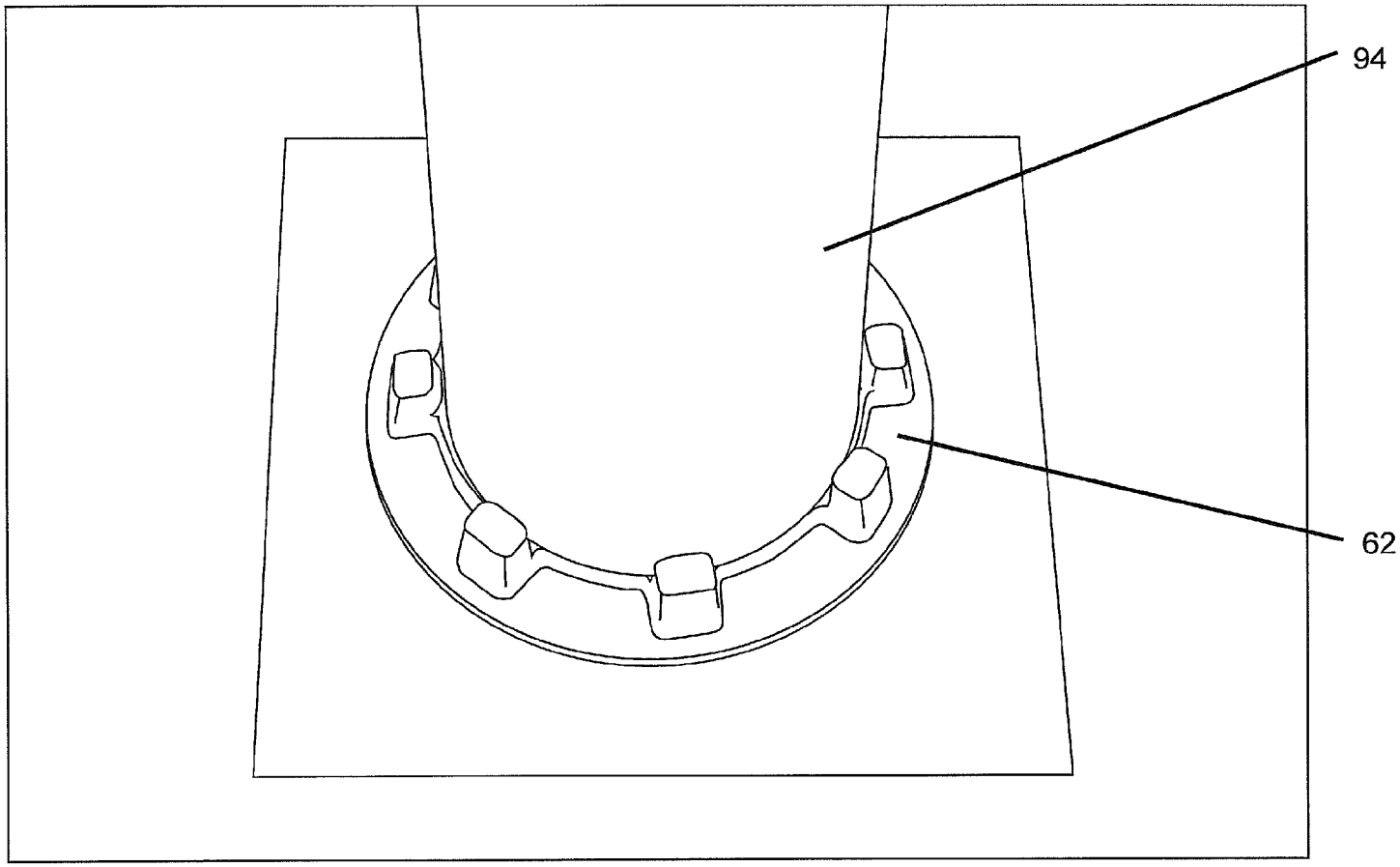
FIG. 27 provides an up close perspective view of a pipe mounted in a connector.

FIG. 27 provides an up close perspective view of stanchion 94 mounted in a stanchion support plate 62. The support plates 62 are suitably secured to the stanchions by adhesive.

Figure 29:
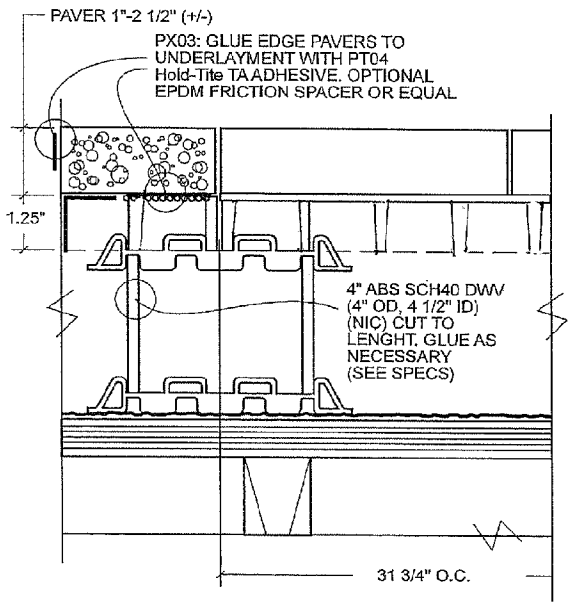
FIGS. 28 and 29 are side sectional views showing the mounting of connectors with pipes and panels, with stone/tile in FIG. 28 and pavers in FIG. 29.
Figure 28:
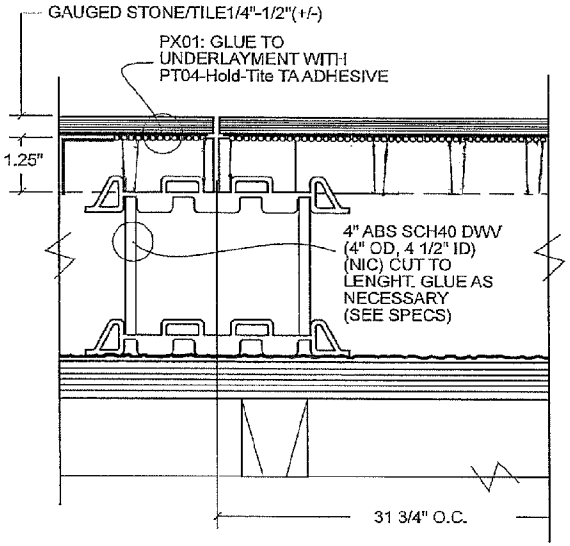

FIGS. 28 and 29 are side sectional views showing the mounting of stanchion support plates with stanchions and panels 70, with stone/tile in FIG. 28, and pavers in FIG. 29.

Accordingly, with the herein described systems, gauged stone or tile may be employed in any outdoor living space (or indoor) in any climate and without the requirement of the use of traditional cement based mortars grouts or adhesives. Also, on grade pavers can be provided to surface the underlayment system with brick/concrete/stone pavers without the need for traditional sand beds.

The components of the systems described herein provide a strong yet light-weight underlayment assembly for a durable and secure exterior flooring surface for elevated decks and rooftop terraces, supplying strength, durability and creative flexibility.

In a particular embodiment, the outdoor floor system described herein weighs only 8-10 lbs. per square foot combined weight of the outdoor floor system underlayment and an average weight of a ¼"-½" gauged stone or tile, which falls within the "10-15 lbs./sq' of dead load" calculations for residential deck construction. Under these conditions the system can be placed over conventionally framed deck structures with joist spacing 16"-24" O.C. A roof top terrace will also only need to be designed for standard load conditions. Paver deck applications will be 10-20 lbs./sq' dead load and will require additional structural reinforcement and consultation with a licensed structural engineer.

The system can cover an existing cracked patio if the subgrade is stable. The finished patio can be installed as a level surface with positive drainage, and no cracks will migrate through the new finished stone surface. It can also be placed over any solid bearing surface. Each panel is supported by the interlocking connectors 62.

The high strength panel members have dimensional stability and minimal deflection under load conditions and require no additional surfacing material to achieve strength. This solid underlayment adds reinforcing strength to a stone/tile surface and bearing strength to a dry-laid paver surface.

The system further provides lateral strength or side-to-side stability, achieved in part by using adhesive to bond panel edges edge-to-edge.

In accordance with the above, a structural underlayment system used for outdoor floors is provided that can be placed over wood or metal joist framing or on a pedestal system. It supports natural gauged stone or tile, brick, concrete or stone pavers and can be used in place of other materials used for elevated decks or rooftop terraces.

Accordingly, as system and method are provided whereby a deck surface of quarried stone is feasible. The use of the fiber reinforced polymer structural panels, the connectors and the adhering of the stone tiles results in a lightweight high strength system weighing only 8 to 10 pounds per square foot in the preferred embodiment. The bonding of the surface material to the structural panel provides further strength to the overall system. As noted above, other surface materials may be employed, including but not limited to tile, brick, concrete and stone pavers.

Under an ASTM #E72-98 test, an exemplary system withstood 6282 lbs. of force with no failure, a maximum 1.47" deflection and a maximum 0.35" set deflection.

The preferred material for the surfacing material 22 is natural quarried stone, which includes slates, quartz and sandstone. All stones are suitably from deep cuts producing the highest quality and highest density stone for exterior applications.

In preferred embodiments, all stones have an ASTM #C121 Water Absorption of 0.10%-0.37%. and an ASTM #C1026 Freeze Thaw unaffected rating or a natural resistance to damage under these conditions. Generally all stones have an ASTM #1028 Coefficient of Friction equal to or greater than most wood or composite products, so as to not be overly slippery as a walking surface. In most cases sealing of the surface is not required due to the high density of this material. However, sealing can enhance the natural beauty if applied, but it is not required for long-term durability.

Although the illustrated embodiment details an outdoor flooring system for use over a wood frame deck surface other uses are also possible. For example, the system and method can be employed as ground level patios, either as new construction or to cover a cracked or otherwise undesirable patio, providing positive drainage. Application to steps is also another use. Further, the system and method can be employed over waterproofed living spaces, for example, by placing the structural panels over the top of the waterproof deck on sleepers (horizontal structural member on or near the ground that support weight) as a level, floating deck, without the use of the connectors so as to provide a floating sub floor that does not penetrate the underlying surface's waterproof membrane.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A subflooring system comprising:

a polymer structural panel with a planar top surface and a planar bottom surface and having a continual array of open square cells formed therethrough, wherein said square cells have side walls that taper inward from the planar top surface to the planar bottom surface;

a square, generally planar, flexible connector, said connector having a top surface, four side walls and a central orifice formed there through, wherein said connector is dimensionally sized for mating, frictional engagement with all four of the tapered side walls of said structural panel cells at a depth to allow a top edge of said connector side walls to reside below the planar top surface of said structural panel; and a mechanical fastener;

wherein where said connector is installed within any of said open square cells, said connector top surface resides below said planar top surface of said structural panel, and wherein said connector accommodates said mechanical fastener therein that is used for attachment of said panel to a surface located directly below said panel; and wherein said connector top surface is generally square in physical configuration with radiused corners, and wherein said connector side walls do not meet adjacent connector side walls at said corners and have serrated edges extending normally therefrom said side walls so as to form a peripheral toothed flange that faces away from said connector so that when installed within any of said open square cells, said connector toothed flange flexes inward towards the center of said connector, so that only said serrated edges frictionally, and bitingly engage all four of the tapered side walls of the cell.

2. The sub flooring system of claim 1 wherein said connector side walls are bent at an angle of approximately 88 degrees from the planar top surface.

3. The sub flooring system of claim 1 further comprising:

at least one tubular stanchion having an upper end and a substantially identical lower end; and at least two support plates each having a first surface and a second surface;

wherein said stanchion upper end frictionally engages said second surface of a first support plate and said stanchion lower end frictionally engages said first surface of a second support plate, so as to form a free standing pedestal adapted to support said structural panel from below.

4. The sub flooring system of claim 3 wherein said first surface of the support plates has raised members of a profile to matingly engage the open cells of said structural panel and has recesses to matingly engage said stanchion ends, and wherein said second surface of the support plates has recesses to matingly engage said stanchion end.

5. The sub flooring system of claim 4 further comprising a connector member that is profiled to matingly engage the first surface of said support plate and extend beyond said support plate's first surface so as to become an alignment guide for a corner of at least one structural panel.

6. The sub flooring system of claim 1 wherein said open cells of said structural panels are generally square and are grouped into square arrays connected to adjacent groups of square arrays having four sides by cuttable connector tabs dispersed between said sides of said square arrays.

7. A sub flooring system comprising:

a composite structural panel having a planar top face and a planar bottom face, and with a uniform array of square open cells formed there through so as to form a grid pattern, wherein said cells have tapered internal side walls that narrow from said planar top face of said structural panel to said planar bottom face of said structural panel; and a flexible adhesive, wherein said adhesive is applied between said planar top surface of said structural panel and a surfacing material such that said structural panel and said surfacing material are bonded together; and a flexible connector having a top surface, four flexible side walls and a central orifice formed there through to accommodate a mechanical fastener wherein said connector resides entirely within one of said cells and frictionally engages with the tapered internal side walls of said structural panel cells at a depth to allow the entire said connector to reside below the planar top surface of said structural panel; and wherein said open cells of said structural panels are grouped into square arrays connected to adjacent groups of square arrays having four sides by cuttable connector tabs dispersed between said sides of said square arrays and wherein said flexible adhesive is comprised of an adhesive sheet, wherein said adhesive is applied between said planar to surface of said polymer structural panel and a surfacing material such that said structural panel and said surfacing material are bonded together; and wherein said square arrays are sized to correspond to conventional flooring product sizes of 16 inches and 24 inches; and wherein said connector top surface is planar and generally square in physical configuration and wherein said connector flexible side walls have a toothed periphery such that when said connector is placed in frictional engagement with the tapered side walls of said structural panel cells, only said toothed periphery contacts the tapered side walls of a cell.

8. The sub flooring system of claim 7 further comprising:

at least one tubular stanchion having an upper end and a substantially identical lower end; and at least two support plates each having a first surface and a second surface;

wherein said stanchion upper end frictionally engages said second surface of a first support plate and said stanchion lower end frictionally engages said first surface of a second support plate, so as to form a free standing pedestal adapted to support said structural panel from below.

9. The sub flooring system of claim 8 wherein said first surface of the support plates has at least one of a raised member of a profile to matingly engage the open cells of said structural panel and has at least one of a first recess to matingly engage said stanchion ends, and wherein said second surface of the support plates has at least one of a second recess to matingly engage said stanchion end.

10. The sub flooring system of claim 9 further comprising a connector member that is profiled to matingly engage the first surface of said support plate and extend beyond said support plate's first surface so as to become an alignment guide for a corner of at least one structural panel.

* * * * *